US006431620B2

(12) United States Patent
Tremblay et al.

(10) Patent No.: US 6,431,620 B2
(45) Date of Patent: Aug. 13, 2002

(54) MECHANISM FOR SELECTIVELY OPERATING AND LOCKING A PIVOTABLE WINDOW

(76) Inventors: Martin Tremblay, 7515, Jodelle, Laval Ouest, Québec (CA), H7R 5L5; Guy Guillemet, 1441, Daunais, Terrebonne, Québec (CA), J6W 3Y1

( * ) Notice: Subject to any disclaimer, the term of this patent is extended or adjusted under 35 U.S.C. 154(b) by 37 days.

(21) Appl. No.: 09/753,600

(22) Filed: Jan. 4, 2001

(30) Foreign Application Priority Data

Jan. 5, 2000 (GB) ..... 0000039

(51) Int. Cl.[7] ..... E05C 17/32

(52) U.S. Cl. ..... 292/263; 292/268; 292/338; 292/DIG. 20; 292/DIG. 12; 292/DIG. 33; 292/DIG. 47; 49/345; 49/339; 49/346

(58) Field of Search ..... 292/263, 262, 292/268, 269, 338, DIG. 12, DIG. 20, DIG. 33, DIG. 47; 49/345, 339, 346

(56) References Cited

U.S. PATENT DOCUMENTS 3,728,820 A * 4/1973 Lange ..... 292/274
3,949,528 A * 4/1976 Bates et al. ..... 292/140
4,254,583 A * 3/1981 Smits et al. ..... 49/246
4,833,754 A * 5/1989 Yang ..... 16/337
4,930,185 A * 6/1990 Hutton ..... 16/325
4,955,159 A * 9/1990 Rogers ..... 292/226
4,982,947 A * 1/1991 McQuigge ..... 16/235
4,991,886 A * 2/1991 Nolte et al. ..... 292/161
5,491,930 A * 2/1996 La See ..... 49/252
5,531,045 A * 7/1996 Piltingsrud ..... 49/279
D376,098 S * 12/1996 Bucher ..... D8/400
5,815,984 A * 10/1998 Sheets et al. ..... 49/246
5,839,229 A * 11/1998 Briggs et al. ..... 49/246
5,927,768 A * 7/1999 Dallmann et al. ..... 292/139
6,044,587 A * 4/2000 Vetter et al. ..... 49/324
6,065,248 A * 5/2000 Sasaki et al. ..... 49/394
6,233,888 B1 * 5/2001 Wu ..... 16/104
6,314,681 B1 * 11/2001 Moody ..... 49/343

* cited by examiner

*Primary Examiner*—J. J. Swann
*Assistant Examiner*—Matthew E. Rodgers

(57) ABSTRACT

A mechanism for selectively operating and locking a pivotal window. The window is pivotally attached to a window frame so as to pivot between open and closed configurations. The mechanism includes an actuating rod slidably mounted to the window frame. A guiding arm is pivotally mounted to the window frame. An actuating arm is pivotally attached to the actuating rod. The distal end of the actuating arm is attached to the window by attachment component allowing for angular compensation. The distal end of the guiding arm is pivotally attached to the actuating arm intermediate the longitudinal ends of the latter. A pin and slot arrangement allows for selective pivotal or locking action between the guiding and actuating arms depending on their relative pivotal relationship. The sliding movement of the actuating rod along its longitudinal axis in one direction causes the window to open while the sliding movement of the actuating rod in the opposite direction along its longitudinal axis causes the window to close and eventually to be locked in the closed configuration.

20 Claims, 11 Drawing Sheets

16
158
134
138
146
152
150
140
154
142
148
158
156
140
138
20
136
166
20
106
58
56
48
52
92
90
46
94
88
112
98
50
60
84
74
68
62
66
72
104
100

134
140
20
VII
80
108
52
69
92
60
90
94
46
84
74
68
62
VII
80
64

Fig. 5
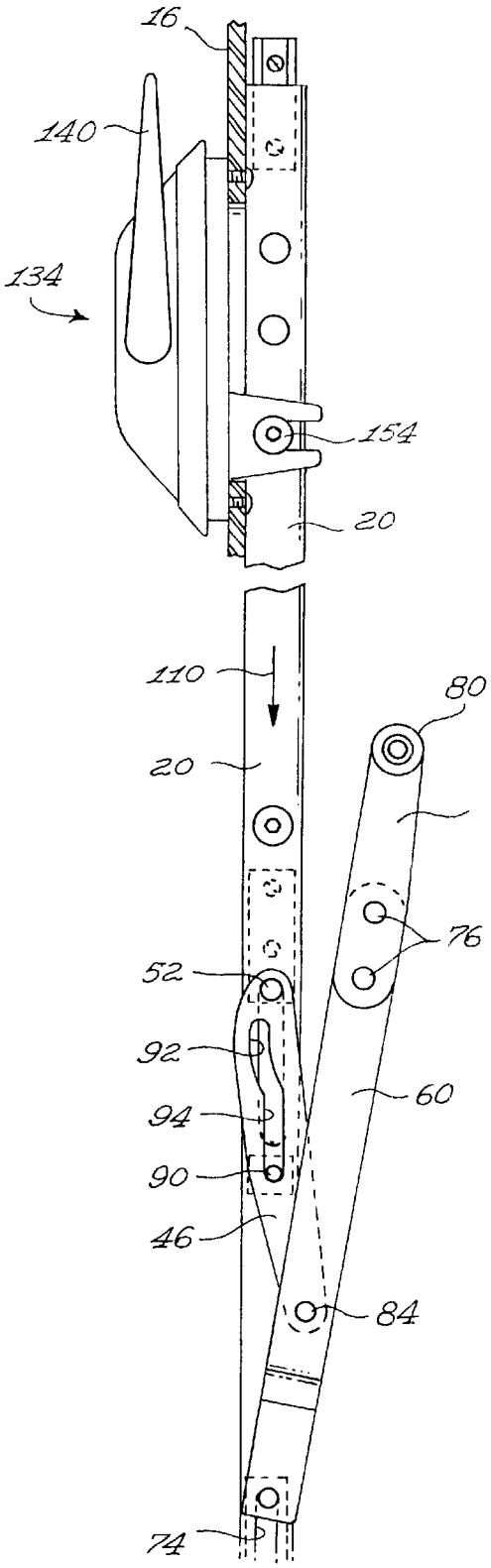
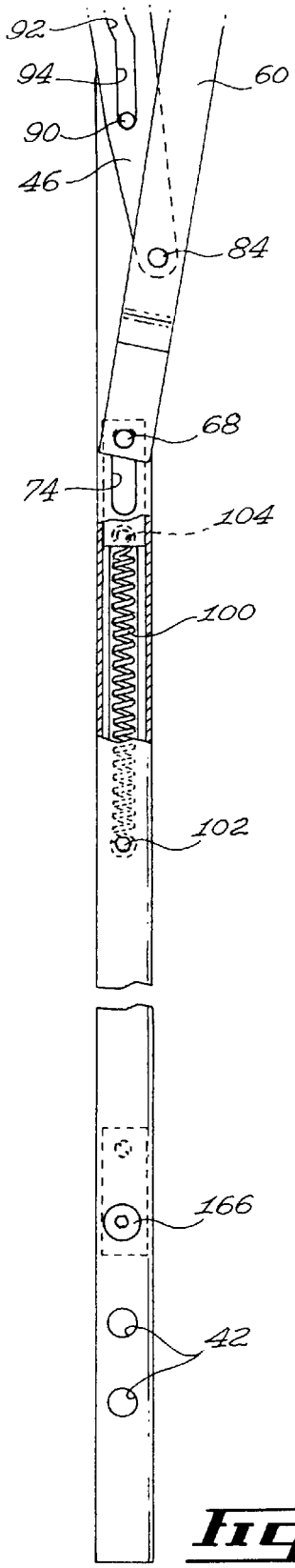
Fig. 6

MECHANISM FOR SELECTIVELY OPERATING AND LOCKING A PIVOTABLE WINDOW

FIELD OF THE INVENTION

The present invention relates to the field of doors, windows and the like and is particularly concerned with a mechanism for selectively operating and locking a pivotable window or door.

BACKGROUND OF THE INVENTION

The prior art is replete with various types of structures for allowing pivotal movement of so-called partition wall aperture obstructing components such as doors, windows or the like between opened and closed configurations. The field of windows, whether of the casement or of the transom-type, is particularly rich in hand-operated devices including pivoted links performing the opening and closing operations.

Commonly, these prior art structures include a track mountable to a window frame and a sash arm mountable to a window sash.

Pivotable links and associated structures such as a shoe slidable in the track mounts the sash arm to the track in order to support the window sash when pivoted between opened and closed configurations.

In the closed configuration, the sash arm and links are disposed opposite the track with the inside of the sash arm aligned with the inside edge of the track to assure tight closing of the window.

Windows usually include two such mechanisms operating together on opposite sides of the window.

When such prior art structures also provide locking features for locking the window in the closed configuration, they usually require an additional handle component for operating the locking components. Thus, the intended user need to perform two separate actions for opening-closing and for locking-unlocking the window. This can prove to be both tedious and unergonomical.

Furthermore, the use of two separate handles deters the overall aesthetical appearance of the window frame and can prove to be cumbersome especially when one of the handle is of the rotating-type which can interfere with the operation of adjacent components such as window blinds or the like.

Also, some of the prior art structures suffer from numerous drawbacks including overall complexity, leading to increased costs and decreased reliability. Accordingly, there exist a need for an improved mechanism for selectively operating and locking a pivotal window.

Advantages of the present invention include the fact that the proposed mechanism allows for combined closing and locking of the window through a single continuous movement of a single handle and for the unlocking and opening of the window, also through a single continuous movement of the same single handle. This provides for an ergonomic handling of the window and reduces the risk of both deterring the overall aesthetical appearance of the window frame and potentially obstructing adjacent components such as window blinds or the like.

Furthermore, the proposed mechanism having a built-in locking feature, may easily be combined with other conventional locking components so as to provide for dual locking action.

The proposed mechanism is specifically designed so as to be easily and readily mounted to conventional windows and window frames without requiring special tooling or manual dexterity.

The proposed mechanism is specifically designed so as to reduce the risks of having the mechanism jam and is also designed so as to provide a reliable operation without requiring expensive maintenance thereof.

The proposed mechanism is specifically designed so as to be manufactured using conventional forms of manufacturing and relatively simple mechanical components so as to provide a mechanism which will be economically feasible, long lasting and relatively trouble free in operation.

SUMMARY OF THE INVENTION

In accordance with an embodiment of the invention there is provided a mechanism for selectively operating and locking a pivotable window, the window being pivotally attached to a window frame so as to pivot between a window open configuration and a window closed configuration about a window pivotal axis, the mechanism comprising: an actuating rod, the actuating rod having an elongated configuration defining a rod first end, a rod second end and a rod longitudinal axis; a rod mounting means for slidably mounting the actuating rod on the window frame so as to allow the actuating rod to slide relative to the window frame along the rod longitudinal axis; a guiding arm, the guiding arm defining a guiding arm first end and a guiding arm second end; a guiding arm-to-window frame attachment means extending between the guiding arm and the window frame for pivotally attaching the guiding arm adjacent the guiding arm first end to the window frame adjacent the actuating rod, the guiding arm-to-window frame attachment means allowing the guiding arm to pivot relative to the window frame about a guiding arm pivotal axis; an actuating arm, the actuating arm defining an actuating arm first end, an actuating arm second end and an actuating arm longitudinal axis; an actuating arm-to-actuating rod attachment means extending between the actuating arm and the actuating rod for pivotally attaching the actuating arm adjacent the actuating arm first end to the actuating rod, the actuating arm-to-actuating rod attachment means allowing the actuating arm to pivot relative to the actuating rod about an actuating arm pivotal axis an actuating arm-to-window attachment means extending from the actuating arm adjacent the actuating arm second end for attaching the actuating arm to the window; a linking means extending between the guiding and actuating arms for linking the guiding arm adjacent the guiding arm second end to the actuating arm intermediate the actuating arm first and second ends, the linking means being configured so as to selectively allow and prevent pivotal movement between the guiding and actuating arms about a linking pivotal axis depending upon the distance between the guiding arm-to-window frame attachment means and the actuating arm-to-actuating rod attachment means; whereby slidable movement of the actuating rod relative to the window frame along the rod longitudinal axis in a rod first direction causes the distance between the guiding arm-to-window frame attachment means and the actuating arm-to-actuating rod attachment means to decrease causing the linking means to assume an unlocked configuration and eventually causing the actuating arm to push the window towards the window open configuration; slidable movement of the actuating rod relative to the window frame along the rod longitudinal axis in a rod second direction opposite to the rod first direction causes the distance between the guiding arm-to-window frame attachment means and the actuating arm-to-actuating rod attachment means to increase causing the actuating arm to pull the window towards the window closed configuration and eventually causing the linking means to assume a locked configuration.

Preferably, the linking means includes a linking slot and a linking pin inserted in the linking slot, the linking slot defining a linking slot pivotal section allowing relative pivotal movement between the actuating and guiding arms, the linking slot also defining an integrally extending linking slot locking section preventing relative pivotal movement between the actuating and guiding arms.

Conveniently, the actuating arm-to-window attachment means includes a connecting tongue extending from the actuating arm second end, the connecting tongue being reversibly bendable between a tongue rectilinear configuration wherein the connecting tongue extends in a generally parallel configuration with the actuating arm longitudinal axis and a tongue bent configuration wherein the connecting tongue has a distal section thereof laterally bent in a direction leading away from the actuating rod and leading towards the window, the connecting tongue being attached to the window by a tongue-to-window attachment means allowing the connecting tongue to be slidably attached to the window, whereby the bendable nature of the connecting tongue allows the actuating arm-to-window attachment means to compensate for the angular displacement of the window as the window pivots between the window open and closed configurations.

Preferably, the tongue-to-window attachment means includes a guiding rail mounted on the window and a roller component attached to a distal end of the connecting tongue, the roller component being configured and sized so as to be inserted in the guiding rail, whereby the roller component is retained and guided by the guiding rail as the window pivots between the window open and closed configurations.

Conveniently, the rod mounting means includes at least one rod mounting block attached to the window frame, the actuating rod defining a cross-sectional configuration allowing the actuating rod to slide on the rod mounting block and to be guided by the latter.

Preferably, the at least one rod mounting block defines a block base and a pair of laterally extending block flanges, the actuating rod having a generally "C"-shaped cross-sectional configuration defining a pair of rod retaining legs, each of the retaining legs being configured and sized so as to slidably grip one of the block flanges.

In accordance with one embodiment of the invention the actuating arm-to-actuating rod attachment means includes an actuating arm-to-actuating rod attachment pin attached at a first end thereof to a pin mounting block and at a second end thereof to the actuating arm, the pin mounting block being secured to the actuating rod between the rod retaining legs and the actuating arm-to-actuating rod attachment pin extending through a rod pin aperture formed in the actuating rod.

Preferably, the guiding arm-to-window frame attachment means includes a guiding arm-to-window frame attachment pin attached at a first end thereof to the window frame and at a second end thereof to the guiding arm adjacent the guiding arm first, the guiding arm-to-window frame attachment pin extending through an attachment pin slot formed in the actuating rod, the attachment pin slot allowing the guiding arm-to-window frame attachment pin to slide thereinto when the actuating rod moves along the actuating rod longitudinal axis.

Conveniently, the mechanism further comprises a handle coupled to the actuating rod for moving the actuating rod relative to the window frame in both the rod first and second directions.

Preferably, the guiding arm pivotal axis and the actuating arm pivotal axis intercept substantially perpendicularly a common axis, the common axis being in a generally parallel relationship with the actuating rod longitudinal axis, the guiding and actuating arms being configured and sized so that the linking axis is positioned laterally relative to the common axis throughout the pivotal movement of the window between the window open and closed configurations.

Conveniently, the actuating arm defines a main segment extending from the actuating arm second end along the actuating arm longitudinal axis and an auxiliary segment extending from the main segment adjacent the actuating arm first end, the auxiliary segment being angled inwardly relative to the main segment, the auxiliary segment being attached by the actuating arm-to-actuating rod attachment means to the actuating rod.

In accordance with two embodiments of the invention the linking pin and the linking slot are configured and sized so as to prevent the slidable insertion of the linking pin in the linking slot locking section until the linking and guiding arms reach a predetermined angular relationship relative to each other, the linking slot locking section being sized so as to prevent rotation of the linking pin when the linking pin is inserted thereinto.

In accordance with one of those two embodiments, the linking slot is formed in the actuating arm; the linking slot pivotal section has a generally disc-shaped configuration allowing pivotal movement of the linking pin thereinto; the linking slot locking section is narrower then the linking slot pivotal section and has a generally rectilinear configuration defining a slot longitudinal axis; the linking pin has a generally rectangular cross-sectional configuration defining a pin longitudinal cross-sectional axis and a perpendicular pin transversal cross-sectional axis, the linking pin being sized so as to only allow insertion thereof in the linking slot locking section when the pin longitudinal cross-sectional axis is aligned with the slot longitudinal axis, whereby slidable movement of the actuating rod relative to the window frame along the rod longitudinal axis in the rod second direction causes the distance between the guiding arm-to-window frame attachment means and the actuating arm-to-actuating rod attachment means to increase causing the actuating and guiding arms to pivot about the linking pin located in the linking slot pivotal section until the pin longitudinal cross-sectional axis is aligned with the slot longitudinal axis and the window is in the window closed configuration, continued slidable movement of the actuating rod relative to the window frame along the rod longitudinal axis in the rod second direction causes the linking pin to slide into the linking slot locking section preventing relative pivotal movement between the guiding and actuating arms until slidable movement of the actuating rod relative to the window frame is reversed and the linking pin reaches the linking slot pivotal section, once the linking pin has reached the linking slot pivotal section continued movement of the actuating rod in the rod first direction moves the actuating arm-to-actuating rod attachment means towards the guiding arm-to-window frame attachment means causing the actuating arm to push the window towards the window open configuration.

In accordance with the other one of those two embodiments, the linking slot is formed in the actuating arm; the linking slot pivotal section generally has the configuration of a disc-segment defining a pair of divergent edges and an interrupted arcuate edge, the linking slot pivotal section allowing pivotal movement of the linking pin thereinto; the linking slot locking section is narrower then the linking slot pivotal section and has a generally rectilinear configuration defining a slot longitudinal axis, one of the longitudinal edges of the linking slot locking section being continuous with one of the divergent edges while the other longitudinal edge of the linking slot locking section intercepts the arcuate edge; the linking pin has a generally oval cross-sectional configuration defining a pin longitudinal cross-sectional axis and a perpendicular pin transversal cross-sectional axis, the linking pin being sized so as to only allow insertion thereof in the linking slot locking section when the pin longitudinal cross-sectional axis is aligned with the slot longitudinal axis, whereby slidable movement of the actuating rod relative to the window frame along the rod longitudinal axis in the rod second direction causes the distance between the guiding arm-to-window frame attachment means and the actuating arm-to-actuating rod attachment means to increase causing the actuating and guiding arms to pivot about the linking pin located in the linking slot pivotal section until the pin longitudinal cross-sectional axis is aligned with the slot longitudinal axis and the window is in the window closed configuration, continued slidable movement of the actuating rod relative to the window frame along the rod longitudinal axis in the rod second direction causes the linking pin to slide into the linking slot locking section preventing relative pivotal movement between the guiding and actuating arms until slidable movement of the actuating rod relative to the window frame is reversed and the linking pin reaches the linking slot pivotal section, once the linking pin has reached the linking slot pivotal section continued movement of the actuating rod in the rod first direction moves the actuating arm-to-actuating rod attachment means towards the guiding arm-to-window frame attachment means causing the actuating arm to push the window towards the window open configuration.

Conveniently, the linking pin is provided with a friction reducing means for reducing the frictional force between the linking pin and the linking slot.

Preferably, the guiding arm is pivotally attached to the actuating arm by a guiding-to-actuating attachment pin; the linking slot is formed in the guiding arm; the linking slot pivotal section has a generally arcuate configuration, the linking slot pivotal section allowing slidable movement of the linking pin thereinto; the linking slot locking section has a generally rectilinear configuration defining a slot longitudinal axis; the linking pin extends from the actuating rod, whereby slidable movement of the actuating rod relative to the window frame along the rod longitudinal axis in the rod second direction causes the distance between the guiding arm-to-window frame attachment means and the actuating arm-to-actuating rod attachment means to increase causing the actuating and guiding arms to pivot about the attachment pin and the linking pin located in the linking slot pivotal section to slide thereinto until the linking pin reaches the linking slot locking section, continued slidable movement of the actuating rod relative to the window frame along the rod longitudinal axis in the rod second direction causes the linking pin to slide into the linking slot locking section preventing relative pivotal movement between the guiding and actuating arms until slidable movement of the actuating rod relative to the window frame is reversed and the linking pin reaches the linking slot pivotal section, once the linking pin has reached the linking slot pivotal movement continued movement of the actuating rod in the rod first direction moves the actuating arm-to-actuating rod attachment means towards the guiding arm-to-window frame attachment means causing the actuating arm to push the window towards the window open configuration while the linking path slides in the linking slot pivotal section.

Conveniently, the mechanism further comprises a biasing means for biasing the linking pin towards the linking slot pivotal section. Preferably, the biasing means includes a slidable attachment means for slidably attaching the actuating arm-to-actuating rod attachment means to the actuating rod; a resilient component resiliently pulling the slidable attachment means away from the guiding arm-to-window frame attachment means.

In accordance with another embodiment of the invention there is provided, in combination with a pivotable window adapted to be pivotally attached to a window frame so as to pivot between a window open configuration and a window closed configuration about a window pivotal axis, a mechanism for selectively operating and locking the pivotable window, the mechanism including an actuating rod, the actuating rod having an elongated configuration defining a rod first end, a rod second end and a rod longitudinal axis; a rod mounting means for slidably mounting the actuating rod on the window frame so as to allow the actuating rod to slide relative to the window frame along the rod longitudinal axis; a guiding arm, the guiding arm defining a guiding arm first end and a guiding arm second end; a guiding arm-to-window frame attachment means extending between the guiding arm and the window frame for pivotally attaching the guiding arm adjacent the guiding arm first end to the window frame adjacent the actuating rod, the guiding arm-to-window frame attachment means allowing the guiding arm to pivot relative to the window frame about a guiding arm pivotal axis; an actuating arm, the actuating arm defining an actuating arm first end, an actuating arm second end and an actuating arm longitudinal axis; an actuating arm-to-actuating rod attachment means extending between the actuating arm and the actuating rod for pivotally attaching the actuating arm adjacent the actuating arm first end to the actuating rod, the actuating arm-to-actuating rod attachment means allowing the actuating arm to pivot relative to the actuating rod about an actuating arm pivotal axis an actuating arm-to-window attachment means extending from the actuating arm adjacent the actuating arm second end for attaching the actuating arm to the window; a linking means extending between the guiding and actuating arms for linking the guiding arm adjacent the guiding arm second end to the actuating arm intermediate the actuating arm first and second ends, the linking means being configured so as to selectively allow and prevent pivotal movement between the guiding and actuating arms about a linking pivotal axis depending upon the distance between the guiding arm-to-window frame attachment means and the actuating arm-to-actuating rod attachment means; whereby slidable movement of the actuating rod relative to the window frame along the rod longitudinal axis in a rod first direction causes the distance between the guiding arm-to-window frame attachment means and the actuating arm-to-actuating rod attachment means to decrease causing the linking means to assume an unlocked configuration and eventually causing the actuating arm to push the window towards the window open configuration; slidable movement of the actuating rod relative to the window frame along the rod longitudinal axis in a rod second direction opposite to the rod first direction causes the distance between the guiding arm-to-window frame attachment means and the actuating arm-to-actuating rod attachment means to increase causing the actuating arm to pull the window towards the window closed configuration and eventually causing the linking means to assume a locked configuration.

In accordance with yet another embodiment of the invention there is provided a mechanism for selectively operating and locking a pivotable window, the window being pivotally attached to a window frame so as to pivot between a window open configuration and a window closed configuration about a window pivotal axis, the mechanism comprising: an actuating rod, the actuating rod having an elongated configuration defining a rod first end, a rod second end and a rod longitudinal axis; a rod mounting means for slidably mounting the actuating rod on the window frame so as to allow the actuating rod to slide relative to the window frame along the rod longitudinal axis; a guiding arm, the guiding arm defining a guiding arm first end and a guiding arm second end; a guiding arm-to-window frame attachment means extending between the guiding arm and the window frame for pivotally attaching the guiding arm adjacent the guiding arm first end to the window frame adjacent the actuating rod, the guiding arm-to-window frame attachment means allowing the guiding arm to pivot relative to the window frame about a guiding arm pivotal axis; an actuating arm, the actuating arm defining an actuating arm first end, an actuating arm second end and an actuating arm longitudinal axis; an actuating arm-to-actuating rod attachment means extending between the actuating arm and the actuating rod for pivotally attaching the actuating arm adjacent the actuating arm first end to the actuating rod, the actuating arm-to-actuating rod attachment means allowing the actuating arm to pivot relative to the actuating rod about an actuating arm pivotal axis an actuating arm-to-window attachment means extending from the actuating arm adjacent the actuating arm second end for attaching the actuating arm to the window; a linking means extending between the guiding and actuating arms for linking the guiding arm adjacent the guiding arm second end to the actuating arm intermediate the actuating arm first and second ends, the linking means being configured so as to selectively allow and prevent pivotal movement between the guiding and actuating arms about a linking pivotal axis depending upon the distance between the guiding arm-to-window frame attachment means and the actuating arm-to-actuating rod attachment means; the linking means including a linking slot formed in the actuating arm and a linking pin extending from the guiding arm and inserted in the linking slot, the linking slot defining a linking slot pivotal section allowing relative pivotal movement between the actuating and linking arms, the linking slot also defining an integrally extending linking slot locking section preventing relative pivotal movement between the actuating and linking arms; the linking slot pivotal section allowing pivotal movement of the linking pin thereinto; the linking slot locking section being narrower then the linking slot pivotal section and having a generally rectilinear configuration defining a slot longitudinal axis; whereby slidable movement of the actuating rod relative to the window frame along the rod longitudinal axis in a rod first direction causes the distance between the guiding arm-to-window frame attachment means and the actuating arm-to-actuating rod attachment means to decrease causing the linking means to assume an unlocked configuration and eventually causing the actuating arm to push the window towards the window open configuration; slidable movement of the actuating rod relative to the window frame along the rod longitudinal axis in a rod second direction opposite to the rod first direction causes the distance between the guiding arm-to-window frame attachment means and the actuating arm-to-actuating rod attachment means to increase causing the actuating and guiding arms to pivot about the linking pin located in the linking slot pivotal section until the window is in the window closed configuration, continued slidable movement of the actuating rod relative to the window frame along the rod longitudinal axis in the rod second direction causes the linking pin to slide into the linking slot locking section preventing relative pivotal movement between the guiding and actuating arms until slidable movement of the actuating rod relative to the window frame is reversed and the linking pin reaches the linking slot pivotal section.

BRIEF DESCRIPTION OF THE DRAWINGS

Embodiments of the present invention will now be disclosed, by way of example, in reference to the following drawings in which:

FIG. 5 in a partial perspective view with sections taken out, illustrates the mechanism shown in FIGS. 3 and 4 in a closed and locked configuration;

FIG. 6 in a partial elevational view with sections taken out, illustrates the relationship between a biasing component and other components, part of the mechanism shown in FIGS. 1 through 5;

DETAILED DESCRIPTION

Figure 1:
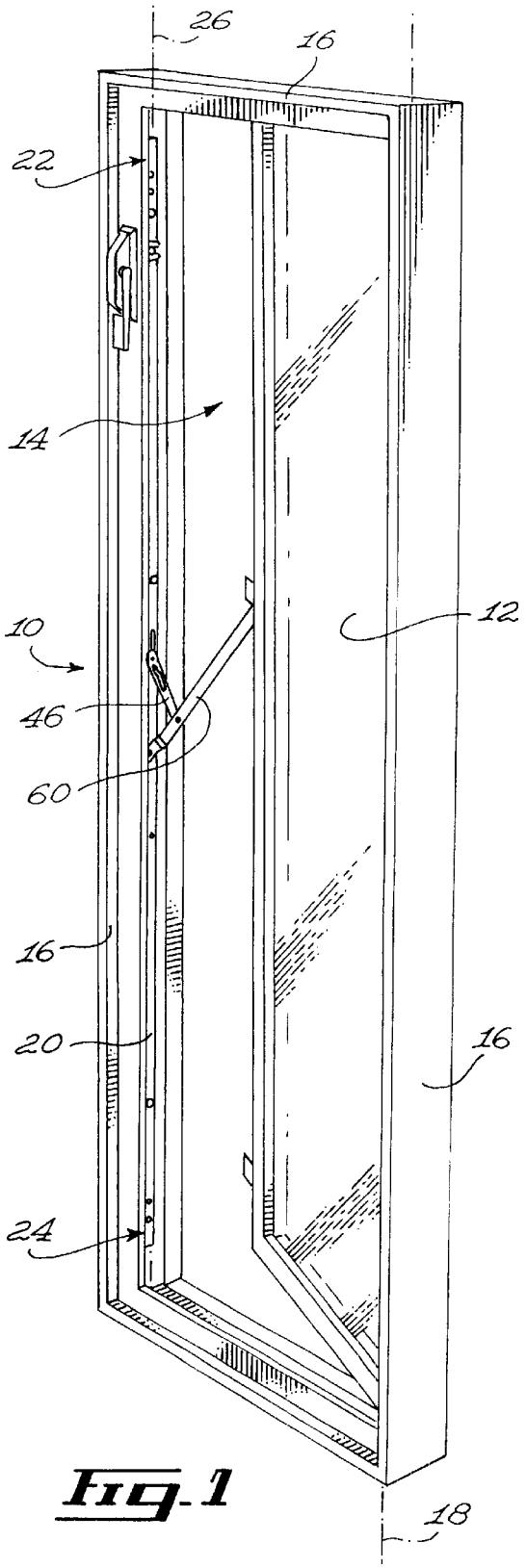
FIG. 1 in a perspective view, illustrates a mechanism in accordance with an embodiment of the present invention attached to a conventional window frame and to a sash window, the mechanism being shown in an opened configuration.
Figure 2:
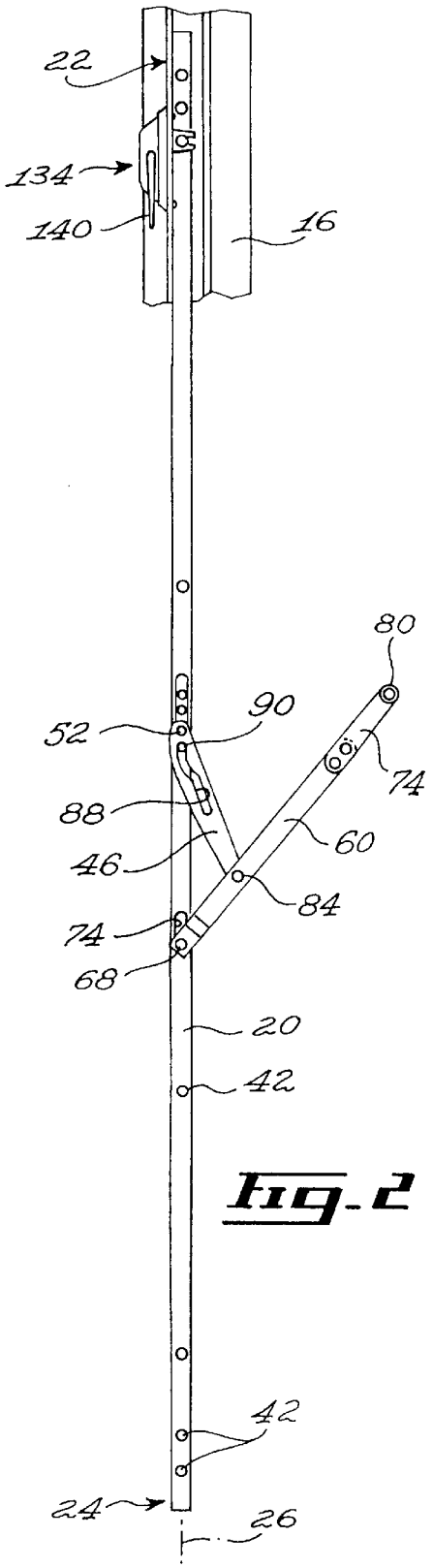
FIG. 2 in a partial elevational view with sections taken out, illustrates the mechanism shown in FIG. 1 in an opened configuration.

Referring to FIG. 1, there is shown a mechanism (10) in accordance with a first embodiment of the present invention.

The mechanism (10) is shown being used for operating and locking a pivotable window (12). The pivotable window (12) is pivotally mounted within a window aperture (14) defined by a window frame (16). The window (12) is pivotally attached to the window frame (16) so as to pivot between a window opened configuration and a window closed configuration about a window pivotal axis (18). Although the window pivotal axis (18) is shown as being substantially vertically oriented in FIG. 1, it should be understood that t he window pivotal axis (18) could take a substantially vertical or angled orientation without departing from the scope of the present invention. Also, although FIG. 1 illustrates a window having a generally rectangular configuration, the mechanism (10) could be used for selectively operating and closing other types of components such as doors or the like, having any suitable configuration and size without departing from the scope of the present invention.

The mechanism (10) includes an actuating rod (20) having a generally elongated configuration and defining a rod first end (22), a rod second end (24) and a rod longitudinal axis (26).

The mechanism (10) also includes a rod mounting means for slidably mounting the actuating rod (20) on the window frame (16) so as to allow the actuating rod (20) to slide relative to the window frame (16) along the rod longitudinal axis (26).

Figure 8:
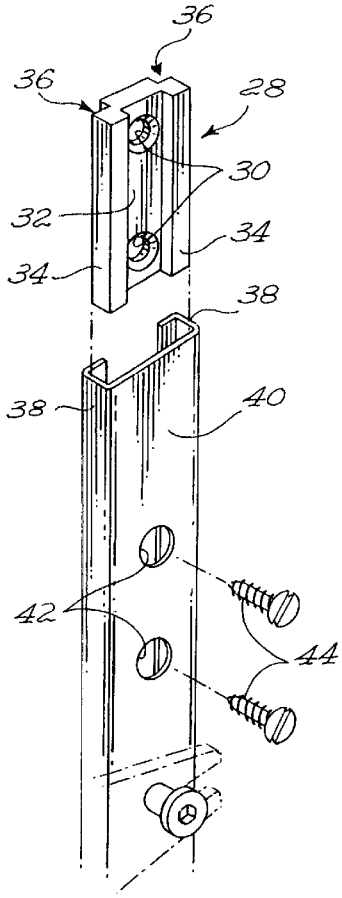
FIG. 8 in a partial perspective view with sections taken out, illustrates part of an actuating rod and associated rod mounting block, both part of a mechanism in accordance with an embodiment of the present invention.

As shown in greater details in FIG. 8, the rod mounting means may typically include at least one rod mounting block (28) attached to the window frame (16) by conventional fastening means such as screws, rivets or the like extending through corresponding apertures (30). When the rod mounting blocks (28) are used, the actuating rod (20) defines a cross sectional configuration allowing the actuating rod (20) to slide on the rod mounting blocks (28) and to be guided by the latter.

Typically, although by no means exclusively, each rod mounting block defines a block base (32) having a generally parallelepiped configuration and a pair of laterally extending block flanges (34). The block flanges (34) are spaced from the window frame (16) so as to define a spacing (36) therebetween.

When the mounting blocks (28) have such a configuration, the actuating rod (20) preferably has a generally C-shaped cross sectional configuration defining a pair of generally L-shaped rod retaining legs (38) and a rod base plate (40). Each of the retaining legs (38) are configured and sized so as to slidably grip one of the block flanges (34). Typically, a plurality of mounting blocks (28) are spaced along the actuating rod (20). The actuating rod (20) is preferably provided with a set of rod apertures (42) extending through the rod base plate (40) for facilitating the installation of the fastening components, such as the screws (44) through the block apertures (30) and into the window frame (16).

Figure 3:
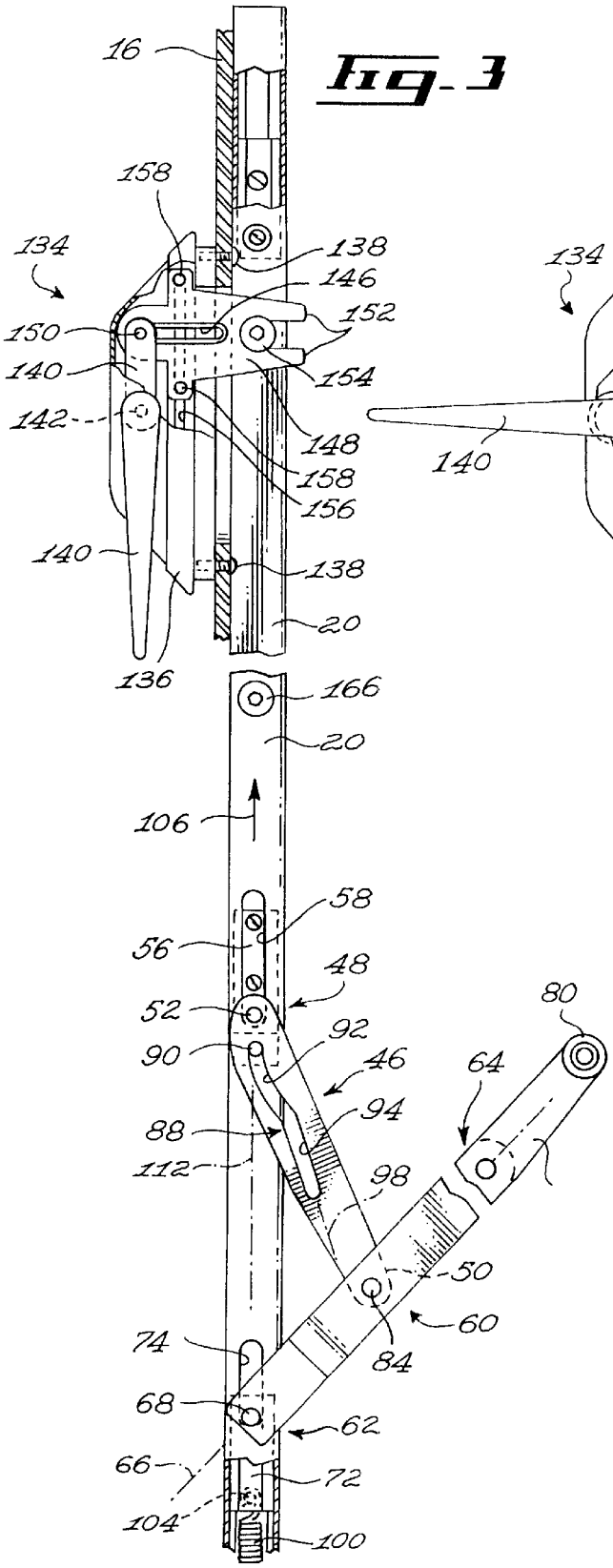
FIG. 3 in a partial elevational view with sections taken out, illustrates some of the components of the mechanism shown in FIGS. 1 and 2.
Figure 4:
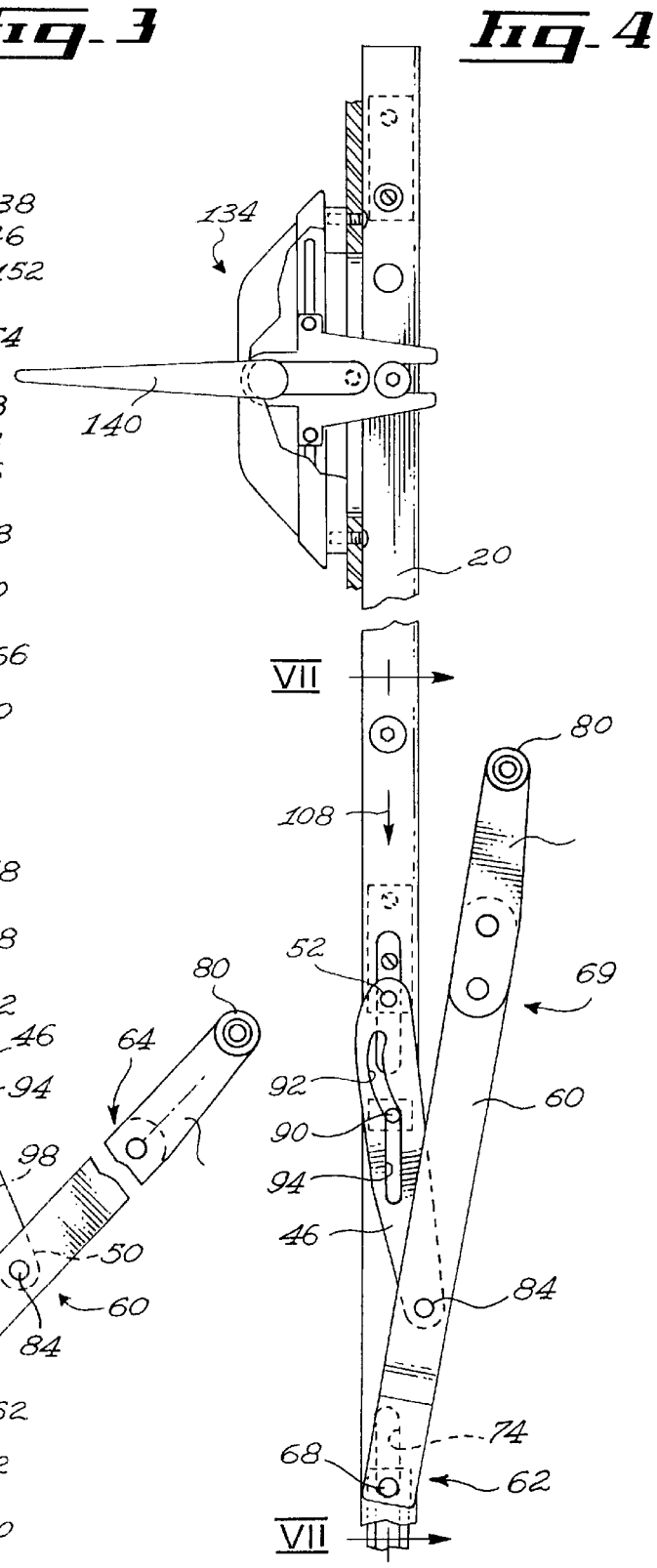
FIG. 4 in a partial elevational view with sections taken out, illustrates the mechanism shown in FIG. 3 in a closed and unlocked configuration.

Referring now more specifically to FIGS. 3 through 5, there is shown that the mechanism (10) also includes a guiding arm (46). The guiding arm (46) defines a guiding arm first end (48) and a longitudinally opposed guiding arms second end (50).

The mechanism (10) also includes a guiding arm-to-window frame attachment means extending between the guiding arm (46) and the window frame (16) for pivotally attaching the guiding arm (46) adjacent its guiding arm first end (48) to the window frame (16) adjacent the actuating rod (20). The guiding arm-to-window frame attachment means allows the guiding arm (46) to pivot relative to the window frame (16) about a guiding arm pivotal axis (52).

Figure 7:
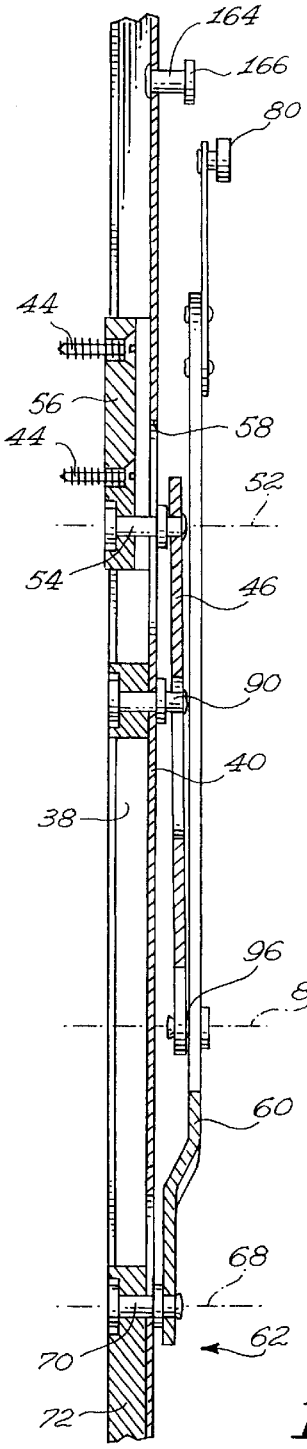
FIG. 7 in a partial longitudinal cross sectional view, illustrates some of the components, part of the mechanism shown in FIGS. 1 through 6.

As shown more specifically in FIG. 7, the guiding arm-to-window frame attachment means typically includes a guiding arm-to-window frame attachment pin (54) attached at a first end thereof to a mounting block (56) secured to the window frame by screws (44). The guiding arm-to-window frame attachment pin (54) is attached at a second end thereof to the guiding arm (46) adjacent the guiding arm first end (48).

Typically, the guiding arm-to-window frame attachment pin (54) extends through an attachment pin slot (58) formed in the plate section (40) of the actuating rod (20).

The attachment pin slot (58) allows the guiding arm-to-window frame attachment pin (54) to slide thereunto when the actuating rod (20) moves along the actuating rod longitudinal axis (26).

Referring back to FIGS. 3 through 5, there is shown that the mechanism (10) further includes an actuating arm (60)

defining an actuating arm first end (62), an actuating arm second end (64) and an actuating arm longitudinal axis (66).

The mechanism (10) still further includes an actuating arm-to-actuating rod attachment means extending between the actuating arm (60) and the actuating rod (20) for pivotally attaching the actuating arm (60) adjacent the actuating arm first end (62) to the actuating rod (20). The actuating arm-to-actuating rod attachment means allows the actuating arm (60) to pivot relative to the actuating rod (20) about an actuating arm pivotal axis (68).

Referring back to FIG. 7, there is shown that the actuating arm-to-actuating rod attachment means typically includes an actuating arm-to-actuating rod attachment pin (70) attached at a first end thereof to a pin mounting block (72) and at a second end thereof to the actuating arm (60). The pin mounting block (72) is secured to the actuating rod (20) between the rod retaining legs (38) and the actuating arm-to-actuating rod attachment pin (70) extends through a rod pin aperture or slot (74) formed in the plate segment of the actuating rod (20).

In the first embodiment illustrated in FIGS. 1 through 12, the pin mounting block (72) is slidably attached by a slidable block attachment means to the actuating rod (20).

The mechanism (10) also further includes an actuating arm-to-window attachment means extending from the actuating arm (60) adjacent the actuating arm second end (64) for attaching the actuating arm (60) to the window (12).

Figure 9:
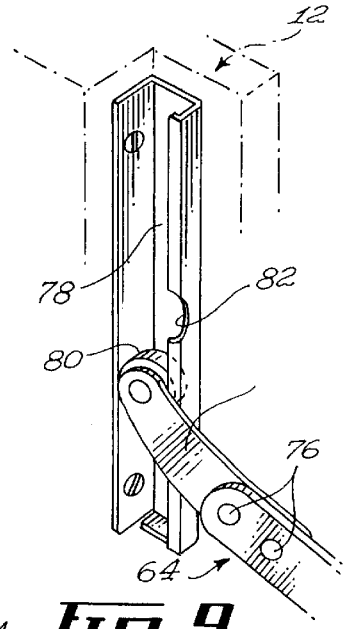
FIG. 9 in a partial perspective view with sections taken out, illustrates a connecting tongue and associated guiding rail used for attaching the mechanism shown in FIGS. 1 through 8 to the pivotable window.

As shown in greater details in FIG. 9, the actuating arm-to-window attachment means typically includes a connecting tongue (74) extending from the actuating arm second end (64). The connecting tongue (74) is preferably attached to the actuating arm second end (64) by conventional attachment means such as rivets (76).

Figure 18:
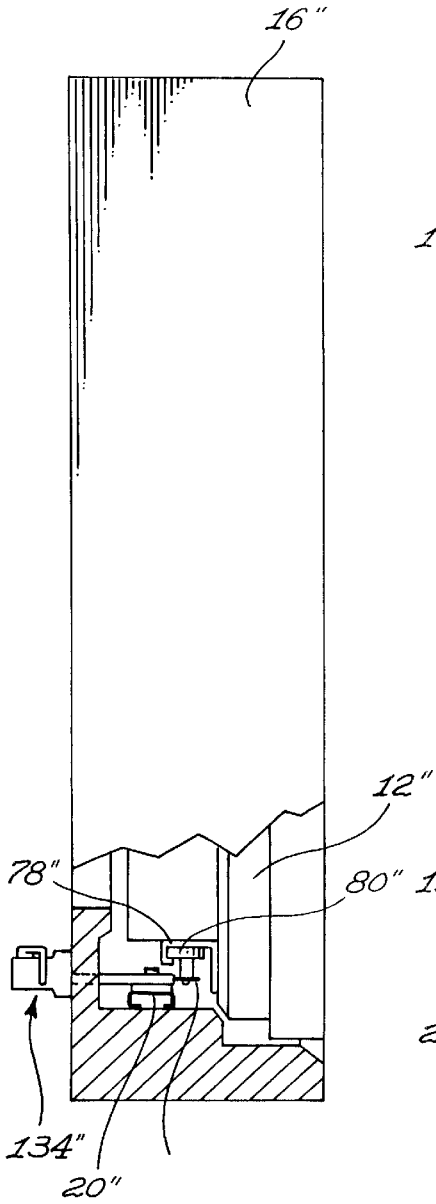
FIG. 18 in a partial top view with sections taken out, illustrates the mechanism shown in FIGS. 16 and 17 in a closed configuration.
Figure 19:
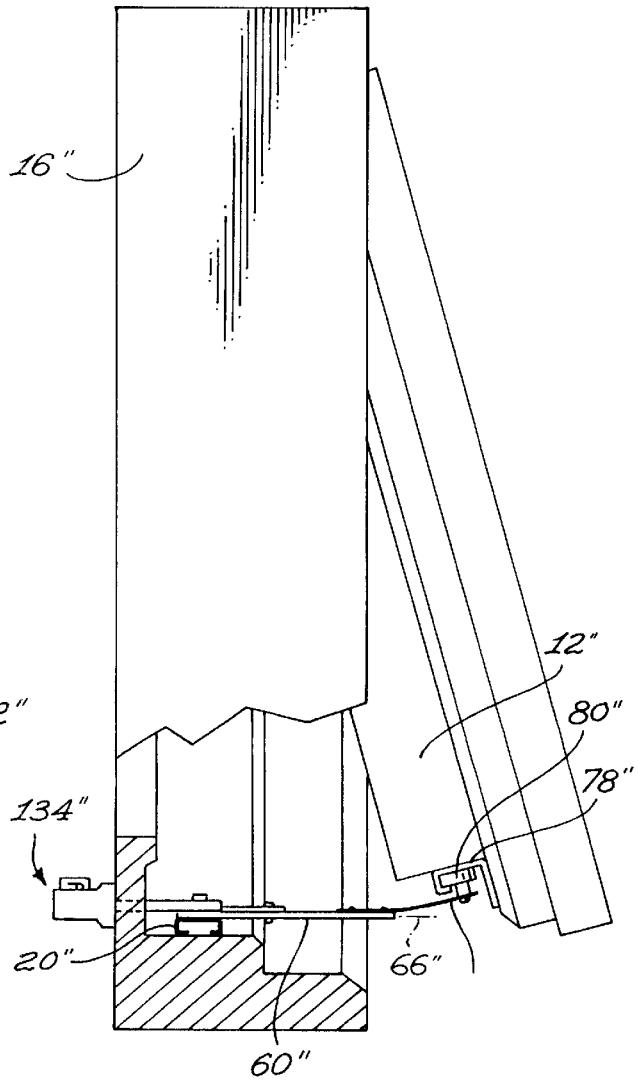
FIG. 19 in a partial top view with sections taken out, illustrates the mechanism shown in FIGS. 16 through 18 in an opened configuration.

As shown more specifically in FIGS. 18 and 19, the connecting tongue (74) is preferably reversibly bendable between a tongue rectilinear configuration wherein the connecting tongue (74) extends in a generally parallel configuration with the actuating arm longitudinal axis (66) and a tongue bent configuration shown in FIG. 19 wherein the connecting tongue (74) has a distal section thereof laterally bent in a direction leading away from the actuating rod (20) and leading towards the window (12). The bendable nature of the connecting tongue (74) allows the actuating arm-to-window attachment means to compensate for the angular displacement of the window (12) as the latter pivots between the window opened and closed configuration respectively illustrated in FIGS. 18 and 19.

The connecting tongue (74) is preferably attached to the window (12) by a tongue-to-window attachment means allowing the connecting tongue (74) to be slidably attached to the window (12). Now referring back to FIG. 9, there is shown that the tongue-to-window attachment means typically includes a guiding rail (78) mounted on the window (12) and a roller component (80) rotatably attached to the distal end of the connecting tongue (74). The roller component (80) is configured and sized so as to be inserted in the guiding rail (78) and to be rollably guided therealong as the window (12) pivots between the window opened and closed configurations. A notch (82) is typically formed in the guiding rail (78) for facilitating insertion and withdrawal of the roller component (80) into and out of the guiding rail (78).

The mechanism (10) still further includes a linking means extending between the guiding and actuating arms (46), (60) for linking the guiding arm (46) adjacent the guiding arm second end (50) to the actuating arm (60) intermediate the actuating arm first and second ends (62), (64). The linking means is configured so as to selectively allow and prevent pivotal movement between the guiding and actuating arms (46), (60) about a linking pivotal axis (84) depending upon the distance between the guiding arm-to-window frame attachment means and the actuating arm-to-actuating rod attachment means.

The linking means includes a linking slot (88) and a linking pin (90). The linking slot (88) defines a linking slot pivotal section (92) allowing relative pivotal movement between the actuating and linking arms (60), (46). The linking slot (88), also defines an integrally extending linking slot locking section (94) preventing the relative pivotal movement between the actuating and guiding arms (60), (46).

In the first embodiment shown in FIGS. 1 through 12, the linking means further includes a guiding-to-actuating arm attachment pin (96) pivotally attaching the guiding arm second end (50) to the actuating arm (60) at intermediate the actuating arm first and second ends (62), (64). Also, in the first embodiment of the invention, the linking slot (88) is formed in the guiding arm (46). In this specific embodiment, the linking slot pivotal section (92) has a generally arcuate configuration allowing the slidable movement of the linking pin (90) thereunto. The linking slot locking section (94) has a generally rectilinear configuration defining a slot longitudinal axis (98). Furthermore, in the first embodiment, the linking pin (90) extends from the actuating rod (20).

Another specific feature of the first embodiment resides in the presence of a biasing means for biasing the linking pin (90) towards the linking slot pivotal section.

As mentioned previously, the actuating arm-to-actuating rod attachment pin (70) is slidably attached to the actuating rod (20) by a slidable block attachment means including the slidable block (72).

As shown in greater details in FIG. 6, a resilient component preferably taking the form of an helicoidal-type spring (100) resiliently pulls the slidable block (72) away from the guiding arm-to-window frame attachment means. The helicoidal-type spring (100) is preferably attached at a distal longitudinal end thereof to a spring attachment pin (102) secured to the actuating rod (20) while the other longitudinal end of the helicoidal-type spring (100) is attached to the slidable block (72) by a spring-to-block attachment pin (104).

In use, slidable movement of the actuating rod (20) relative to the window frame (16) along the rod longitudinal axis (26) in a rod first direction indicated by arrow CVI in FIG. 3, causes the distance between the guiding arm-to-window frame attachment means and the actuating arm-to-actuating rod attachment means to decrease, causing the linking means to assume an unlocked configuration and eventually causing the actuating arm (60) to push the window (12) towards the window open configuration.

Slidable movement of the actuating rod (20) relative to the window frame (16) along the rod longitudinal axis (26) in a rod second direction designated by arrow CVIII in FIG. 4 opposite to the rod first direction (106), causes the distance between the guiding arm-to-window frame attachment means and the actuating arm-to-actuating rod attachment means to increase, causing the actuating arm to pull the window (12) towards the window closed configuration.

More specifically, slidable movement of the actuating rod in the rod second direction, causes the actuating and guiding arms to pivot about the attachment pin (84) and also causes the linking pin (90), located in the linking slot pivotal section (92), to slide thereunto until the linking pin reaches the linking slot locking section, as shown in FIG. 4.

Continued slidable movement of the actuating rod (20) relative to the window frame (16) along the rod longitudinal axis in the rod second direction as indicated by arrow CX in FIG. 5, causes the linking pin (90) to slide into the linking slot locking section (94) thus preventing relative pivotal movement between the guiding and actuating arms (46), (60) until slidable movement of the actuating rod (20) relative to the window frame (16) is reversed and the locking pin (90) reaches back to the linking slot pivotal section (92).

FIGS. 3 through 6, also illustrate that as the actuating rod (20) moves in the rod second direction, the actuating arm-to-actuating rod attachment pin (68) slides within the pin slot (74) towards the guiding arm-to-actuating rod attachment pin (54). During the slidable movement of the pin (70) and associated pin block (72), the helicoidal-type spring (100) is stretched and, thus, biases the pin (68) towards its original position shown in FIG. 3. The biasing force exerted by the helicoidal-type spring (100) is adapted to act as a priming force for facilitating the pivotal movement between the guiding and actuating arms (46), (60) from the locked configuration shown in FIGS. 5 and 6 towards the open configuration shown in FIG. 3.

The guiding arm pivotal axis (52) and the actuating arm pivotal axis (68) intercept substantially perpendicularly a common axis (112). The common axis (112) is typically in a generally parallel relationship with the actuating rod longitudinal axis (26) and is even preferably in a collinear relationship with the latter. The guiding and actuating arms (46), (60) are configured and sized so that the linking axis (84) is positioned laterally relative to the common axis (112) throughout the pivotal movement of the window (12) between the window open and closed configurations. The biasing force exerted by the spring (100) further ensures that the linking axis remains positioned laterally relative to the common axis.

Figure 13:
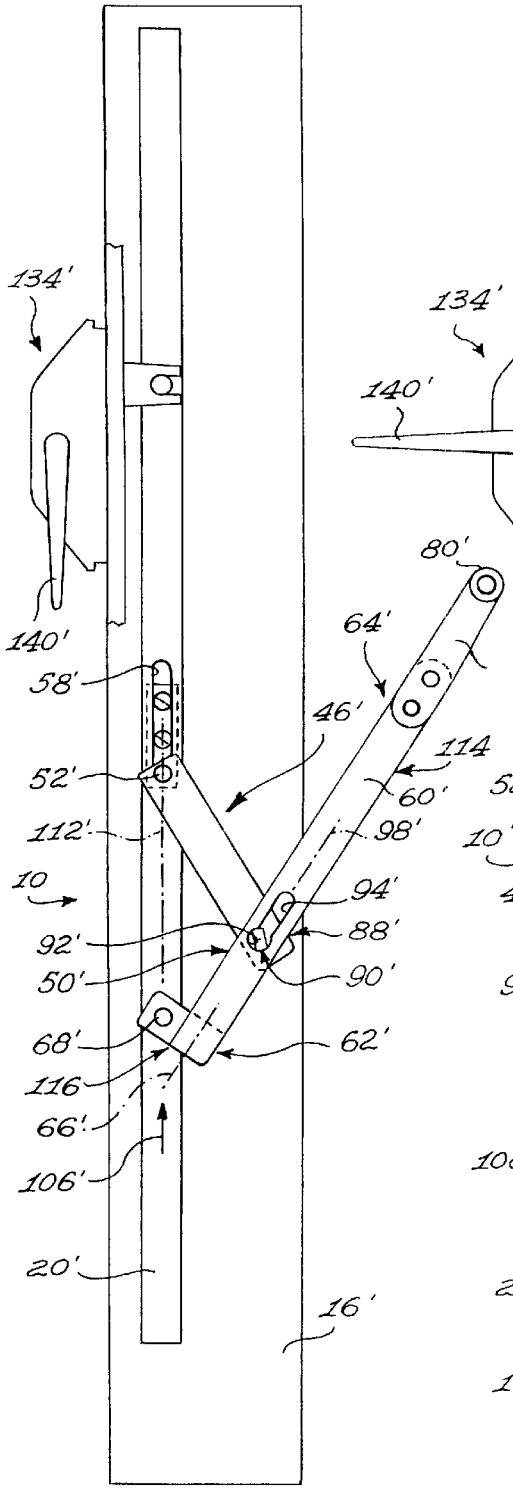
FIG. 13 in a schematic elevational view, illustrates a mechanism in accordance with a second embodiment of the present invention, the mechanism being shown in a opened configuration.
Figure 14:
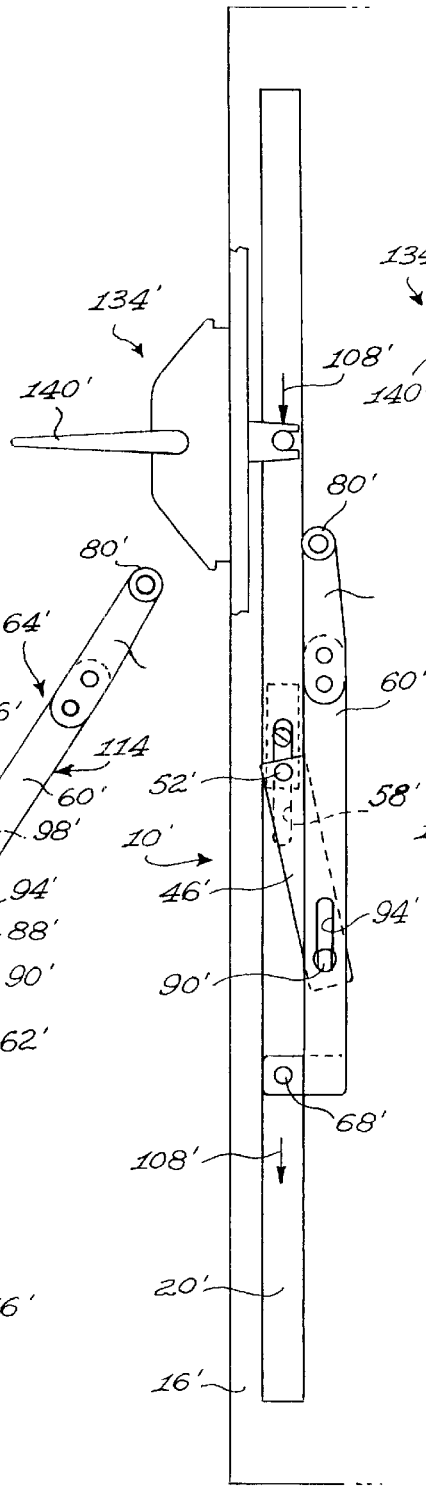
FIG. 14 in a schematic elevational view, illustrates the mechanism shown in FIG. 13 in a closed and unlocked configuration.
Figure 15:
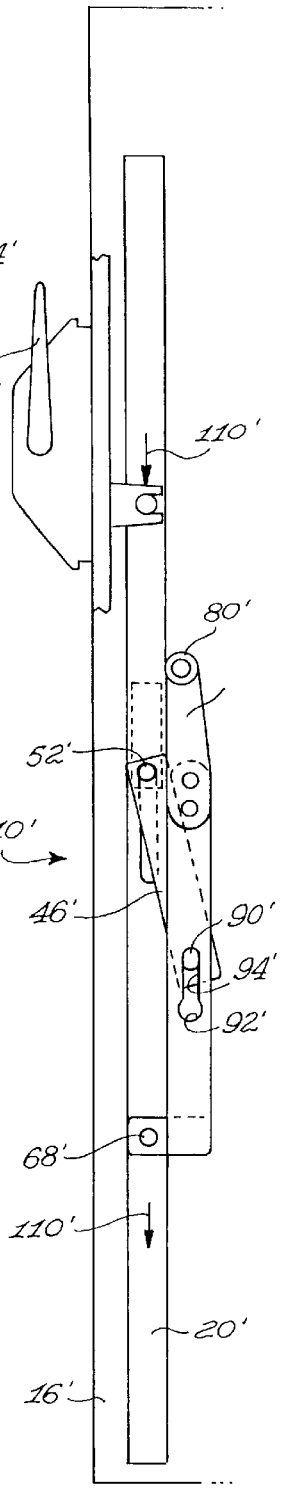
FIG. 15 in a schematic elevational view, illustrates the mechanism shown in FIGS. 13 and 14 in a closed and locked configuration.
Figure 16:
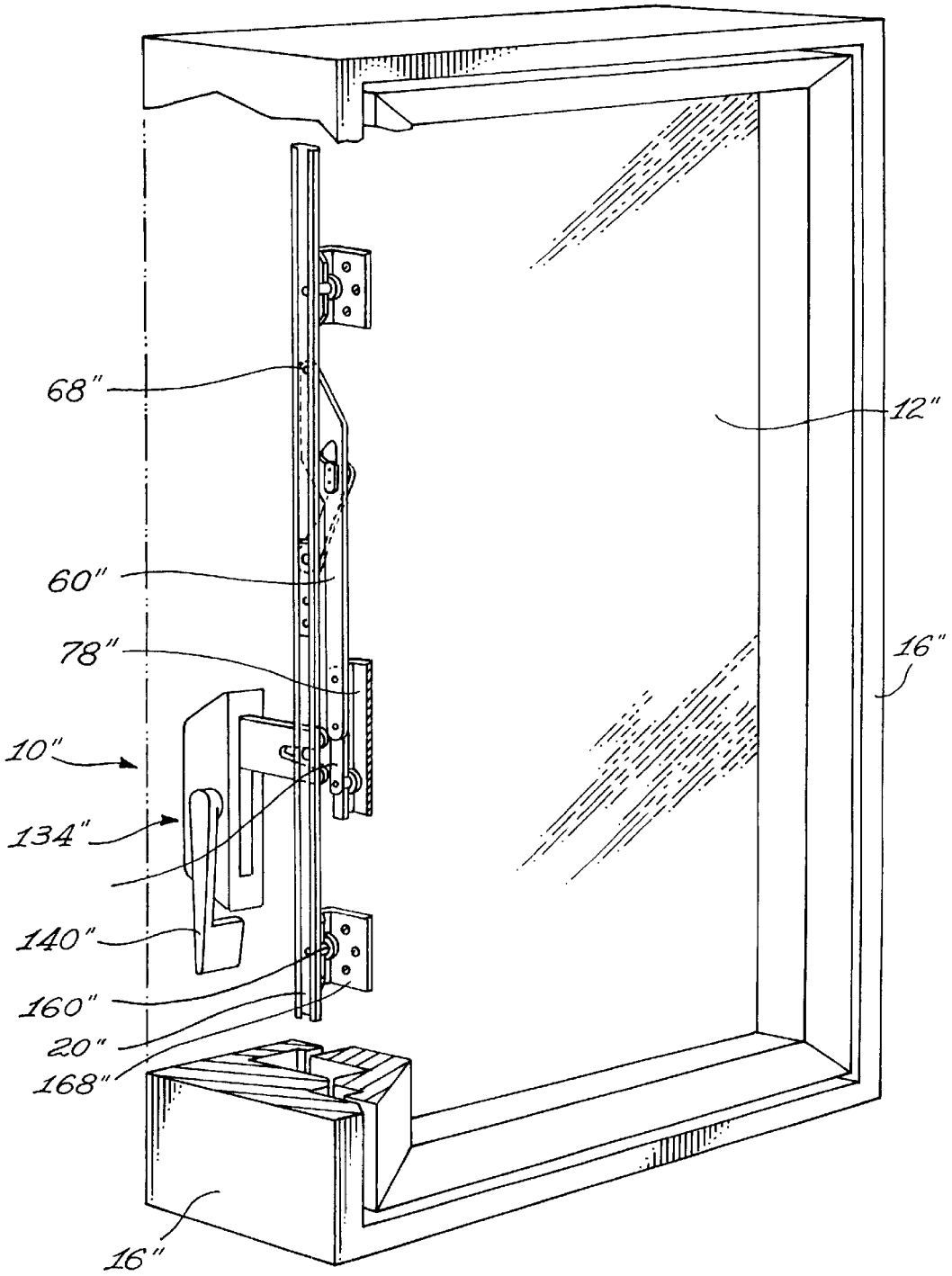
FIG. 16 in a perspective view with sections taken out, illustrates a mechanism in accordance with a third embodiment of the present invention mounted to a conventional window frame and attached to a conventional pivotable window. The mechanism being shown in a closed and locked configuration.
Figure 17:
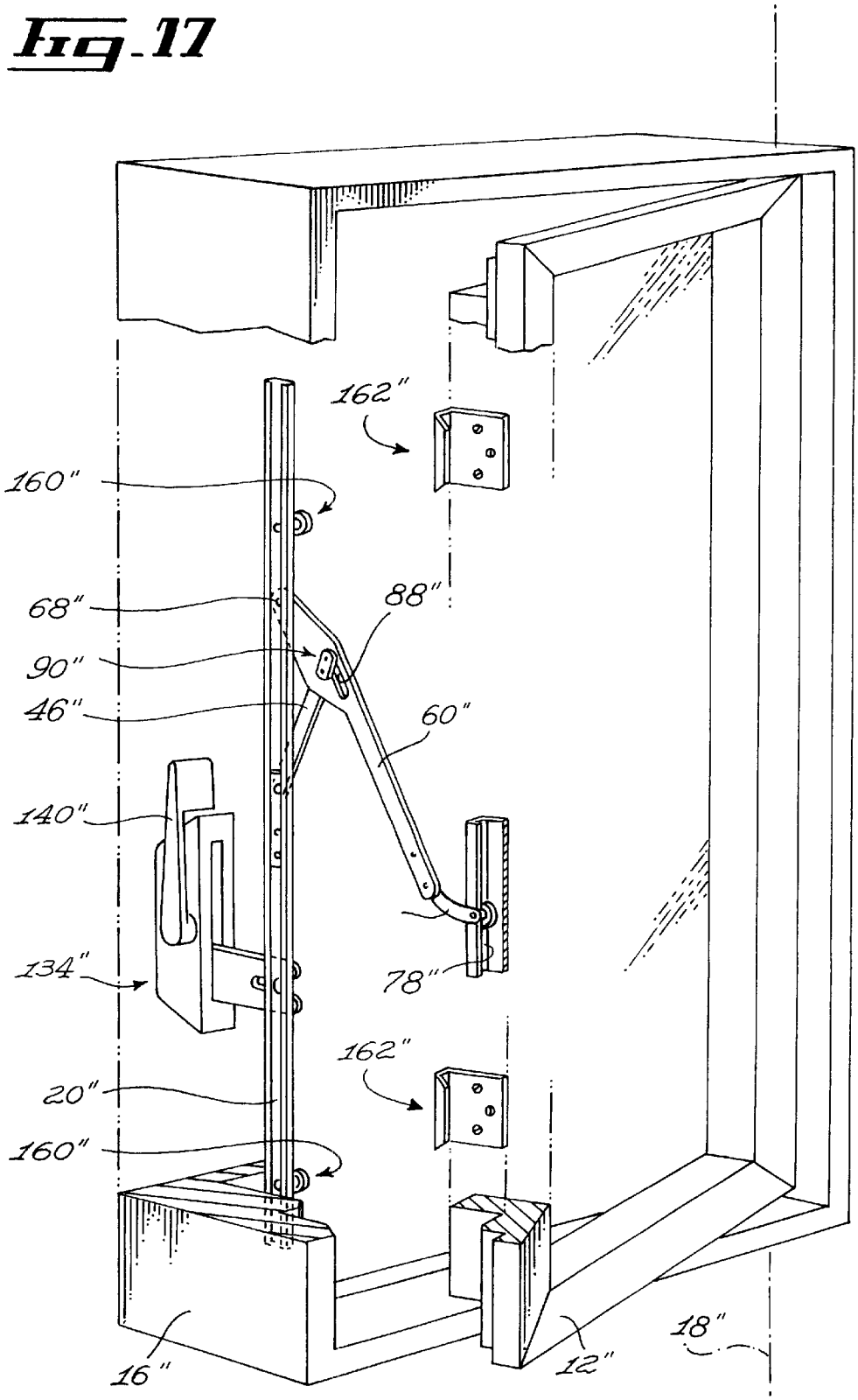
FIG. 17 in a partial perspective view with sections taken out, illustrates the mechanism shown in FIG. 16 in an opened configuration.

Referring now more specifically to FIGS. 13 through 15, there is shown a mechanism (10') in accordance with a second embodiment of the present invention.

The mechanism (10') is substantially similar to the mechanism (10) shown in FIGS. 1 through 12 and, thus, similar reference numerals will be used to denote similar components. One of the main differences between the mechanism (10) and (10') resides in the configuration of the linking means. In the mechanism (10') the linking slot (88') is formed in the actuating arm (60'). The actuating arm-to-guiding arm attachment pin (84) and the linking pin (90) are thus merged into a single linking pin (90') extending from the guiding arm (46') adjacent the guiding arm second end (50'). The linking pin (90') and the linking slot (88') are configured and sized so as to prevent the slidable insertion of the linking pin (90') in the linking slot locking section (94') until the linking and guiding arms (60'), (46') reach a predetermined angular relationship relative to each other. The linking slot locking section (94') is sized so as to prevent rotation of the linking pin (90') when the linking pin (90') is inserted thereunto. The linking slot locking section (94') is narrower than the linking slot pivotal section (92'). Furthermore, the linking slot locking section (94') has a generally rectilinear configuration defining a slot longitudinal axis (98').

The linking slot pivotal section (92') has a generally disc-shaped configuration allowing pivotal movement of the linking pin (90') thereunto.

As shown in FIGS. 13 through 15, the linking pin (90') has a generally rectangular cross sectional configuration defining a pin longitudinal cross sectional axis and a perpendicular pin transversal cross sectional axis. The transversal end edges of the linking pin (90') are preferably given a substantially arcuate configuration. The linking pin (90') is sized so as to only allow insertion thereof in the linking slot locking section (94') when the pin longitudinal cross sectional axis is generally aligned with the slot longitudinal axis (98).

In order to ensure that the linking axis (84') remains positioned laterally relative to the common axis (112') throughout the pivotal movement of the window between the open and closed configurations, the actuating arm (60") is preferably given a specific configuration. The actuating arm (60) preferably defines a main segment (114) extending from the actuating arm second end (64') along the actuating arm longitudinal axis (66'). The actuating arm (60') also defines an auxiliary segment (116) extending from the main segment (114) adjacent to the actuating arm first end (62'). The auxiliary segment (116) is angled inwardly relative to the main segment (114) and is attached by the actuating arm-to-actuating rod attachment means to the actuating rod (20).

In use, slidable movement of the actuating rod (20') relative to the window frame (16') in the rod second direction indicated by arrow CVIII' in FIG. 14, causes the distance between the guiding arm-to-window frame attachment means and the actuating arm-to-actuating rod attachment means to increase causing the actuating and guiding arms (60'), (46') to pivot about the linking pin (90') located in the linking slot pivotal section (92') until the pin longitudinal cross sectional axis is aligned with the slot longitudinal axis (98') and the window is in the window closed configuration. As indicated by arrow CX' in FIG. 15, continued slidable movement of the actuating rod (20') relative to the window frame (16') along the rod longitudinal axis in the rod second direction, causes the linking pin (90') to slide into the linking slot locking section (94') preventing relative pivotal movement between the guiding and actuating arms (46'), (60') until slidable movement of the actuating rod (20') relative to the window frame is reversed, as indicated by arrow CVI' in FIG. 13 and the linking pin (90') reaches the linking slot pivotal section (92'). Once the linking pin (90') has reached the linking slot pivotal section (92'), continued movement of the actuating rod (20') moves the actuating arm to actuating rod attachment means towards the guiding arm-to-window frame attachment means, causing the actuating arm (60') to push the window towards the window open configuration.

Referring now more specifically to FIGS. 16 through 29, there is shown a mechanism (10") in accordance with a third embodiment of the present invention. The mechanism (10") is substantially similar to the mechanism (10') and, hence, similar reference numerals will be used to denote similar components. One of the main differences between the mechanism (10') and the mechanism (10") respectively in accordance with second and third embodiments of the present invention, resides in the specific configuration of the linking slot (88") and linking pin (90").

Figure 23:
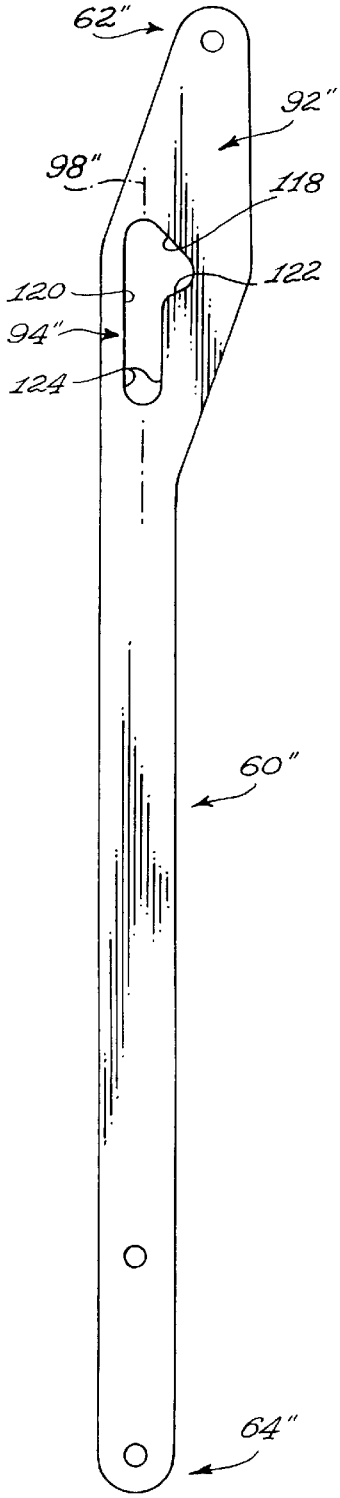
FIG. 23 in a detailed elevational view, illustrates the actuating arm shown in FIG. 22.
Figures 24, 25, 26:
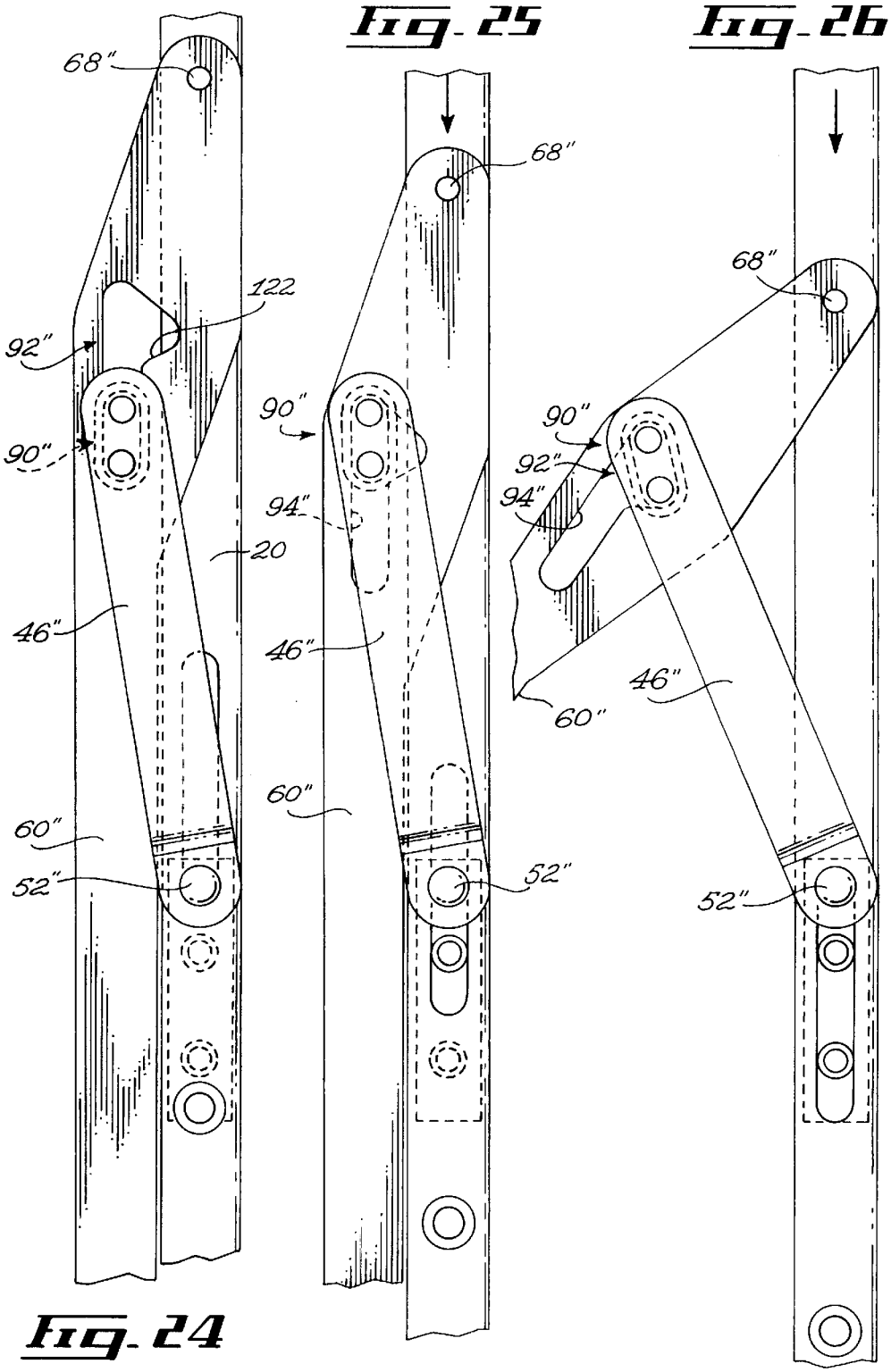
FIG. 24 in a partial elevational view, illustrates the relationship between the actuating rod, the actuating arm and the guiding arm, part of the mechanism shown in FIGS. 16 through 23 when the mechanism is in a closed and locked configuration.
FIG. 25 in a partial elevational view, illustrates the relationship between the actuating rod, the actuating arm and the guiding arm, part of the mechanism shown in FIGS. 16 through 23 when the mechanism is in a closed and unlocked configuration.
FIG. 26 in a partial elevational view, illustrates the relationship between the actuating rod, the actuating arm and the guiding arm, part of the mechanism shown in FIGS. 16 through 23 when the mechanism is in an opened configuration.
Figure 27:
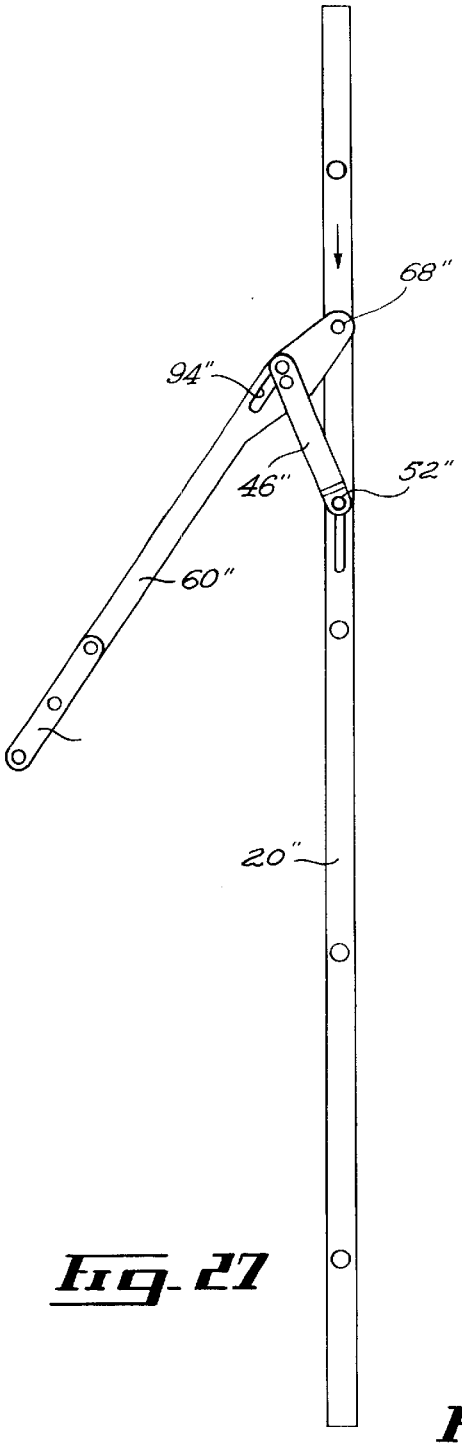
FIG. 27 in an elevational view, illustrates the mechanism shown in FIGS. 16 through 26 in an opened configuration.
Figure 28:
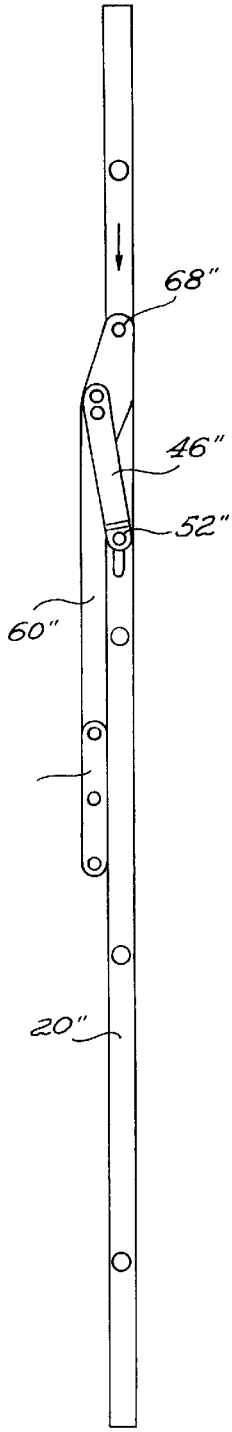
FIG. 28 in an elevational view, illustrates the mechanism shown in FIGS. 16 through 26 in a closed and unlocked configuration.
Figure 29:
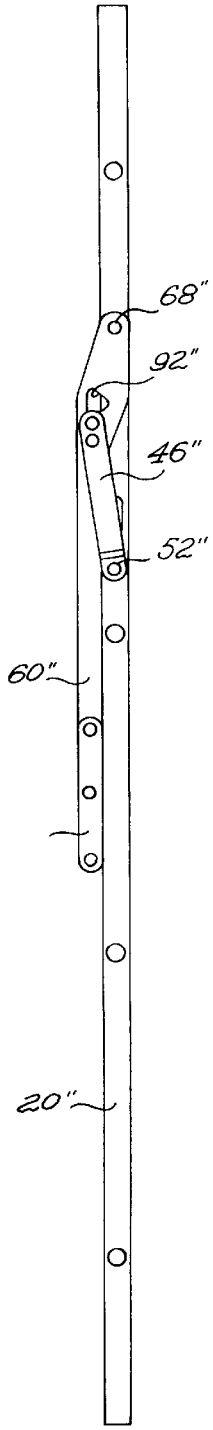
FIG. 29 in an elevational view, illustrates the mechanism shown in FIGS. 16 through 26 in a closed and locked configuration.

As illustrated more specifically in FIG. 23, the linking slot pivotal section (92") generally has a configuration of disc segment defining a pair of divergent edges (118), (120) and an interrupted arcuate edge (122). As in the previous embodiments, the linking slot pivotal section (92") allows the pivotal movement of the linking pin (90") thereunto.

As in the second embodiment (10') the linking slot locking section (94") is narrower than the linking slot pivotal section (92") and has a generally rectilinear configuration defining a slot longitudinal axis (98"). One of the longitudinal edges (124) of the linking slot locking section (94) is in a continuous relationship with the diverging edge (120) while the other longitudinal edge (124) intercepts the arcuate edge (122).

Figure 20:
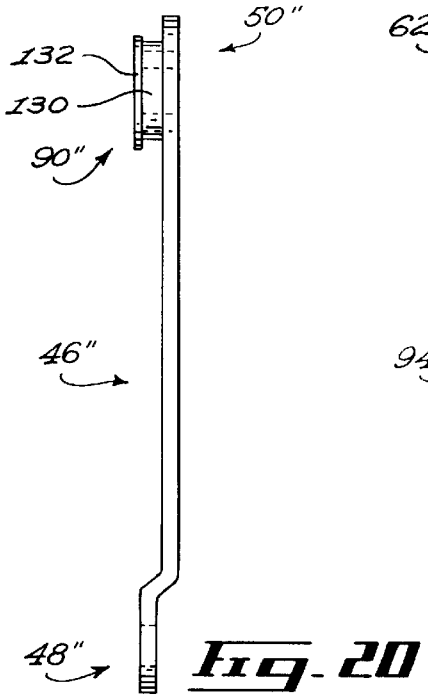
FIG. 20 in a detailed side view, illustrates a guiding arm, part of the mechanism shown in FIGS. 16 through 19.
Figure 21:
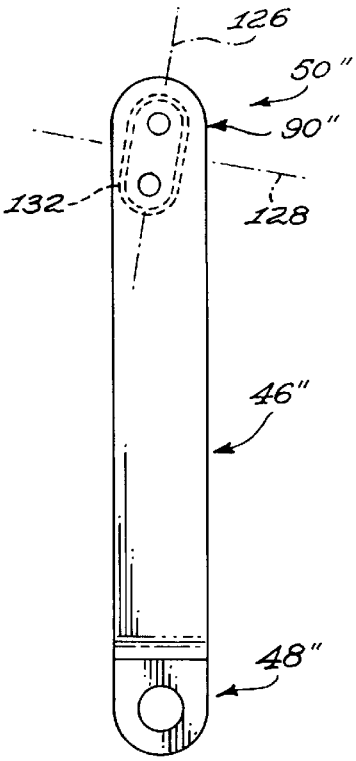
FIG. 21 in a detailed elevational view, illustrates the guiding arm shown in FIG. 20.
Figure 22:
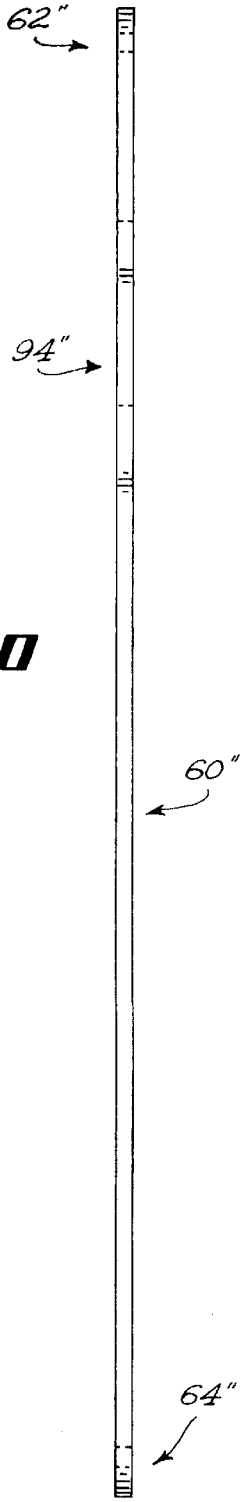
FIG. 22 in a detailed side view, illustrates an actuating arm, part of the mechanism shown in FIGS. 16 through 21.

As shown more specifically in FIGS. 20 and 21, the linking pin (90") has a generally oval cross sectional configuration defining a pin longitudinal cross sectional axis (126) and a perpendicular pin transversal cross sectional axis (128). The linking pin (90") is sized so as to only allow insertion thereof in the linking slot locking segment (94") when the pin longitudinal cross sectional axis (126) is substantially aligned with the slot longitudinal axis (98").

The linking pin (90') is preferably further provided with a friction reducing means for reducing the frictional force between the linking pin (90") and the linking slot (88").

The friction reducing means typically takes the form of a sleeve or coating made out of a friction reducing material such as a suitable polymeric resin overriding the external peripheral surface (130) of the linking pin (90"). The linking pin (90") further preferably extends integrally from the guiding arm (46") and is typically preferably provided with an integral attachment rim (132).

The pivotal movements between the actuating rod (20"), the actuating arm (60") and the guiding arm (46") are substantially similar to that hereinabove described for the second embodiment (10') and are best illustrated in FIGS. 24 through 29.

All three (3) embodiments may optionally further include a handle means coupled to the actuating rod (20) for moving the actuating rod (20) relative to the window frame (60) in both the rod first and second directions. Although any suitable type of handle means could be used. A specific embodiment is shown, by way of example, more specifically in FIG. 3. The handle means is preferably of the continuous type allowing for continuous smooth motion between the window open, closed and locked configurations.

FIG. 3, illustrates a conventional toggle-type handle (134). The toggle-type handle (134) includes a handle frame (136) attached to the window frame by conventional attachment components such as screw or bolts (138). A handle lever (140) is pivotally attached to the handle frame (136) by a handle first pivotal connection (142).

A handle actuating arm (144) mechanically coupled to the handle lever (140) is pivotally and slidably mounted to a handle slot (146) formed in the handle sliding fork (148) by a handle second pivotal connection (150). The handle sliding fork (148) defines a pair of fork tines (152) configured and sized for abuttingly contacting a level-to-actuating rod transmission pin (154).

The handle sliding fork (148) is slidably mounted by sliding pins (158) to a handle sliding track (156) formed in the handle frame (136) preferably adjacent a base section thereof.

As is well known in the art, pivotal movement of the handle lever (140) causes sliding and pivotal movement of the second pivotal connection (150) within the handle slot (146) which, in turn, causes sliding movement of the handle sliding fork (148) and the handle sliding track (156) relative to the handle frame (136).

The sliding movement of the handle sliding fork (148) is, in turn, transmitted to the actuating rod (20) by the lever-to-sliding rail transmission pin (154) so that reciprocating pivotal movement of the handle lever (140) is transformed by the handle means (134) into a reciprocating translational linear movement of the actuating rod (20) relative to the window frame (16).

Although all three (3) embodiments provide a built-in locking feature, they may optionally be further provided with conventional locking pin and plate arrangements for providing additional locking action.

Figure 10:
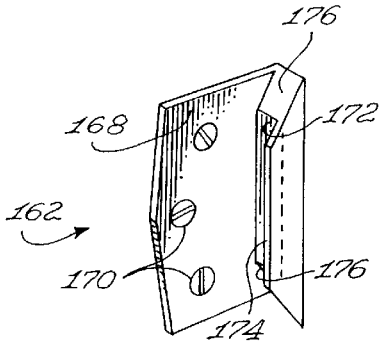
FIG. 10 in a perspective view, illustrates a conventional locking bracket, optionally part of the invention.
Figure 11:
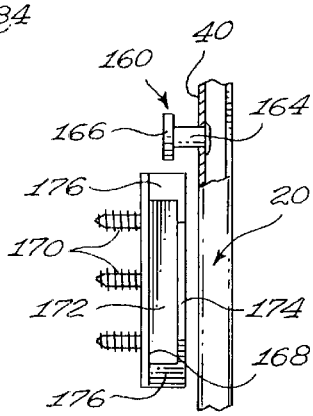
FIG. 11 in a partial side view with sections taken out, illustrates a conventional locking pin about to contact the conventional locking bracket shown in FIG. 10.
Figure 12:
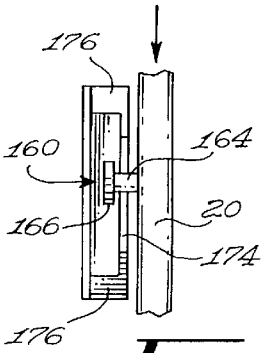
FIG. 12 in a partial side view with sections taken out, illustrates the conventional locking pin in a locked configuration relative to the conventional locking bracket shown in FIGS. 10 and 11.

The conventional locking pin and plate arrangements are illustrated more specifically in FIGS. 10 through 12. The conventional locking pins (160) are solidly attached to the base segment of the actuating rod (20). The locking pins (160) are adapted to cooperate with corresponding locking plates (162) solidly attached to the window frame (16) for providing additional locking action. Each locking pin (160) includes a locking pin attachment segment (164) preferably taking the form of a rivet-like segment, solidly attached to the base segment (40) of the actuating rod (20). Each locking pin (160) also include an integrally and substantially perpendicularly extending disc-shaped locking pin abutment segment (166).

Each locking plate (162) includes a locking plate fixing segment (168) having a set of locking plate fixing segment apertures extending therethrough for receiving a corresponding set of locking plate fixing components such as fixing screws (170).

Each locking plate (162) also includes a generally L-shaped locking plate abutment segment defining an abutment segment base (172) and a generally perpendicularly oriented abutment segment leg (174). The abutment segment base (172) is provided with a set of beveled ramps (176) at each longitudinal end thereof.

As shown in FIGS. 11 and 12, when the actuating rod (20) is translated relative to the window frame (16), the abutment segment (166) of the locking pin (160) abuttingly slides over a corresponding ramp segment (176) until it overrides the base segment (172) and thus prevents pivotal movement of the window (12) by the obstruction action of the leg segment (174), as is well known in the art.

The embodiments of the invention in which an exclusive priviledge or property is claimed are defined as follows:

1. A mechanism for selectively operating and locking a pivotable window, said window being pivotally attached to a window frame so as to pivot between a window open configuration and a window closed configuration about a window pivotal axis, said mechanism comprising:

an actuating rod, said actuating rod having an elongated configuration defining a rod first end, a rod second end and a rod longitudinal axis;

a rod mounting means for slidably mounting said actuating rod on said window frame so as to allow said actuating rod to slide relative to said window frame along said rod longitudinal axis;

a guiding arm, said guiding arm defining a guiding arm first end and a guiding arm second end;

a guiding arm-to-window frame attachment means extending between said guiding arm and said window frame for pivotally attaching said guiding arm adjacent said guiding arm first end to said window frame adjacent said actuating rod, said guiding arm-to-window frame attachment means allowing said guiding arm to pivot relative to said window frame about a guiding arm pivotal axis;

an actuating arm, said actuating arm defining an actuating arm first end, an actuating arm second end and an actuating arm longitudinal axis;

an actuating arm-to-actuating rod attachment means extending between said actuating arm and said actuating rod for pivotally attaching said actuating arm adjacent said actuating arm first end to said actuating rod, said actuating arm-to-actuating rod attachment means allowing said actuating arm to pivot relative to said actuating rod about an actuating arm pivotal axis an actuating arm-to-window attachment means extending from said actuating arm adjacent said actuating arm second end for attaching said actuating arm to said window;

a linking means extending between said guiding and actuating arms for linking said guiding arm adjacent said guiding arm second end to said actuating arm intermediate said actuating arm first and second ends, said linking means being configured so as to selectively allow and prevent pivotal movement between said guiding and actuating arms about a linking pivotal axis depending upon the distance between said guiding arm-to-window frame attachment means and said actuating arm-to-actuating rod attachment means;

whereby slidable movement of said actuating rod relative to said window frame along said rod longitudinal axis in a rod first direction causes the distance between said guiding arm-to-window frame attachment means and said actuating arm-to-actuating rod attachment means to decrease causing said linking means to assume an unlocked configuration and eventually causing said actuating arm to push said window towards said window open configuration;

slidable movement of said actuating rod relative to said window frame along said rod longitudinal axis in a rod second direction opposite to said rod first direction causes the distance between said guiding arm-to-window frame attachment means and said actuating arm-to-actuating rod attachment means to increase causing said actuating arm to pull said window towards said window closed configuration and eventually causing said linking means to assume a locked configuration.

2. A mechanism as recited in claim 1 wherein said linking means includes a linking slot and a linking pin inserted in said linking slot, said linking slot defining a linking slot pivotal section allowing relative pivotal movement between said actuating and guiding arms, said linking slot also defining an integrally extending linking slot locking section preventing relative pivotal movement between said actuating and guiding arms.

3. A mechanism as recited in claim 2 wherein said actuating arm-to-window attachment means includes a connecting tongue extending from said actuating arm second end, said connecting tongue being reversibly bendable between a tongue rectilinear configuration wherein said connecting tongue extends in a generally parallel configuration with said actuating arm longitudinal axis and a tongue bent configuration wherein said connecting tongue has a distal section thereof laterally bent in a direction leading away from said actuating rod and leading towards said window, said connecting tongue being attached to said window by a tongue-to-window attachment means allowing said connecting tongue to be slidably attached to said window, whereby the bendable nature of said connecting tongue allows said actuating arm-to-window attachment means to compensate for the angular displacement of said window as said window pivots between said window open and closed configurations.

4. A mechanism as recited in claim 3 wherein said tongue-to-window attachment means includes a guiding rail mounted on said window and a roller component attached to a distal end of said connecting tongue, said roller component being configured and sized so as to be inserted in said guiding rail, whereby said roller component is retained and guided by said guiding rail as said window pivots between said window open and closed configurations.

5. A mechanism as recited in claim 2 wherein said linking pin and said linking slot are configured and sized so as to prevent the slidable insertion of said linking pin in said linking slot locking section until said linking and guiding arms reach a predetermined angular relationship relative to each other, said linking slot locking section being sized so as to prevent rotation of said linking pin when said linking pin is inserted thereinto.

6. A mechanism as recited in claim 5 wherein said linking slot is formed in said actuating arm;

said linking slot pivotal section has a generally disc-shaped configuration allowing pivotal movement of said linking pin thereinto;

said linking slot locking section is narrower then said linking slot pivotal section and has a generally rectilinear configuration defining a slot longitudinal axis;

said linking pin has a generally rectangular cross-sectional configuration defining a pin longitudinal cross-sectional axis and a perpendicular pin transversal cross-sectional axis, said linking pin being sized so as to only allow insertion thereof in said linking slot locking section when said pin longitudinal cross-sectional axis is aligned with said slot longitudinal axis, whereby slidable movement of said actuating rod relative to said window frame along said rod longitudinal axis in said rod second direction causes the distance between said guiding arm-to-window frame attachment means and said actuating arm-to-actuating rod attachment means to increase causing said actuating and guiding arms to pivot about said linking pin located in said linking slot pivotal section until said pin longitudinal cross-sectional axis is aligned with said slot longitudinal axis and said window is in said window closed configuration, continued slidable movement of said actuating rod relative to said window frame along said rod longitudinal axis in said rod second direction causes said linking pin to slide into said linking slot locking section preventing relative pivotal movement between said guiding and actuating arms until slidable movement of said actuating rod relative to said window frame is reversed and said linking pin reaches said linking slot pivotal section, once said linking pin has reached said linking slot pivotal section continued movement of said actuating rod in said rod first direction moves said actuating arm-to-actuating rod attachment means towards said guiding arm-to-window frame attachment means causing said actuating arm to push said window towards said window open configuration.

7. A mechanism as recited in claim 5 wherein said linking slot is formed in said actuating arm;

said linking slot pivotal section generally has the configuration of a disc-segment defining a pair of divergent edges and an interrupted arcuate edge, said linking slot pivotal section allowing pivotal movement of said linking pin thereinto;

said linking slot locking section is narrower then said linking slot pivotal section and has a generally rectilinear configuration defining a slot longitudinal axis, one of the longitudinal edges of said linking slot locking section being continuous with one of said divergent edges while the other longitudinal edge of said linking slot locking section intercepts said arcuate edge;

said linking pin has a generally oval cross-sectional configuration defining a pin longitudinal cross-sectional axis and a perpendicular pin transversal cross-sectional axis, said linking pin being sized so as to only allow insertion thereof in said linking slot locking section when said pin longitudinal cross-sectional axis is aligned with said slot longitudinal axis, whereby slidable movement of said actuating rod relative to said window frame along said rod longitudinal axis in said rod second direction causes the distance between said guiding arm-to-window frame attachment means and said actuating arm-to-actuating rod attachment means to increase causing said actuating and guiding arms to pivot about said linking pin located in said linking slot pivotal section until said pin longitudinal cross-sectional axis is aligned with said slot longitudinal axis and said window is in said window closed configuration, continued slidable movement of said actuating rod relative to said window frame along said rod longitudinal axis in said rod second direction causes said linking pin to slide into said linking slot locking section preventing relative pivotal movement between said guiding and actuating arms until slidable movement of said actuating rod relative to said window frame is reversed and said linking pin reaches said linking slot pivotal section, once said linking pin has reached said linking slot pivotal section continued movement of said actuating rod in said rod first direction moves said actuating arm-to-actuating rod attachment means towards said guiding arm-to-window frame attachment means causing said actuating arm to push said window towards said window open configuration.

8. A mechanism as recited in claim 7 wherein said linking pin is provided with a friction reducing means for reducing the frictional force between said linking pin and said linking slot.

9. A mechanism as recited in claim 5 wherein said guiding arm is pivotally attached to said actuating arm by a guiding-to-actuating attachment pin;

said linking slot is formed in said guiding arm;

said linking slot pivotal section has a generally arcuate configuration, said linking slot pivotal section allowing slidable movement of said linking pin thereinto;

said linking slot locking section has a generally rectilinear configuration defining a slot longitudinal axis;

said linking pin extends from said actuating rod, whereby slidable movement of said actuating rod relative to said window frame along said rod longitudinal axis in said rod second direction causes the distance between said guiding arm-to-window frame attachment means and said actuating arm-to-actuating rod attachment means to increase causing said actuating and guiding arms to pivot about said attachment pin and said linking pin located in said linking slot pivotal section to slide thereinto until said linking pin reaches said linking slot locking section, continued slidable movement of said actuating rod relative to said window frame along said rod longitudinal axis in said rod second direction causes said linking pin to slide into said linking slot locking section preventing relative pivotal movement between said guiding and actuating arms until slidable movement of said actuating rod relative to said window frame is reversed and said linking pin reaches said linking slot pivotal section, once said linking pin has reached said linking slot pivotal movement continued movement of said actuating rod in said rod first direction moves said actuating arm-to-actuating rod attachment means towards said guiding arm-to-window frame attachment means causing said actuating arm to push said window towards said window open configuration while said linking path slides in said linking slot pivotal section.

10. A mechanism as recited in claim 9 further comprising a biasing means for biasing said linking pin towards said linking slot pivotal section.

11. A mechanism as recited in claim 10 wherein said biasing means includes a slidable attachment means for slidably attaching said actuating arm-to-actuating rod attachment means to said actuating rod;

a resilient component resiliently pulling said slidable attachment means away from said guiding arm-to-window frame attachment means.

12. A mechanism as recited in claim 1 wherein said rod mounting means includes at least one rod mounting block attached to said window frame, said actuating rod defining a cross-sectional configuration allowing said actuating rod to slide on said rod mounting block and to be guided by the latter.

13. A mechanism as recited in claim 12 wherein said at least one rod mounting block defines a block base and a pair of laterally extending block flanges, said actuating rod having a generally "C"-shaped cross-sectional configuration defining a pair of rod retaining legs, each of said retaining legs being configured and sized so as to slidably grip one of said block flanges.

14. A mechanism as recited in claim 13 wherein said actuating arm-to-actuating rod attachment means includes an actuating arm-to-actuating rod attachment pin attached at a first end thereof to a pin mounting block and at a second end thereof to said actuating arm, said pin mounting block being secured to said actuating rod between said rod retaining legs and said actuating arm-to-actuating rod attachment pin extending through a rod pin aperture formed in said actuating rod.

15. A mechanism as recited in claim 1 wherein said guiding arm-to-window frame attachment means includes a guiding arm-to-window frame attachment pin attached at a first end thereof to said window frame and at a second end thereof to said guiding arm adjacent said guiding arm first, said guiding arm-to-window frame attachment pin extending through an attachment pin slot formed in said actuating rod, said attachment pin slot allowing said guiding arm-to-window frame attachment pin to slide thereinto when said actuating rod moves along said actuating rod longitudinal axis.

16. A mechanism as recited in claim 1 further comprising a handle coupled to said actuating rod for moving said actuating rod relative to said window frame in both said rod first and second directions.

17. A mechanism as recited in claim 1 wherein said guiding arm pivotal axis and said actuating arm pivotal axis intercept substantially perpendicularly a common axis, said common axis being in a generally parallel relationship with said actuating rod longitudinal axis, said guiding and actuating arms being configured and sized so that said linking axis is positioned laterally relative to said common axis throughout the pivotal movement of said window between said window open and closed configurations.

18. A mechanism as recited in claim 17 wherein said actuating arm defines a main segment extending from said actuating arm second end along said actuating arm longitudinal axis and an auxiliary segment extending from said main segment adjacent said actuating arm first end, said auxiliary segment being angled inwardly relative to said main segment, said auxiliary segment being attached by said actuating arm-to-actuating rod attachment means to said actuating rod.

19. In combination with a pivotable window adapted to be pivotally attached to a window frame so as to pivot between a window open configuration and a window closed configuration about a window pivotal axis, a mechanism for selectively operating and locking said pivotable window, said mechanism including an actuating rod, said actuating rod having an elongated configuration defining a rod first end, a rod second end and a rod longitudinal axis;

a rod mounting means for slidably mounting said actuating rod on said window frame so as to allow said actuating rod to slide relative to said window frame along said rod longitudinal axis;

a guiding arm, said guiding arm defining a guiding arm first end and a guiding arm second end;

a guiding arm-to-window frame attachment means extending between said guiding arm and said window frame for pivotally attaching said guiding arm adjacent said guiding arm first end to said window frame adjacent said actuating rod, said guiding arm-to-window frame attachment means allowing said guiding arm to pivot relative to said window frame about a guiding arm pivotal axis;

an actuating arm, said actuating arm defining an actuating arm first end, an actuating arm second end and an actuating arm longitudinal axis;

an actuating arm-to-actuating rod attachment means extending between said actuating arm and said actuating rod for pivotally attaching said actuating arm adjacent said actuating arm first end to said actuating rod, said actuating arm-to-actuating rod attachment means allowing said actuating arm to pivot relative to said actuating rod about an actuating arm pivotal axis an actuating arm-to-window attachment means extending from said actuating arm adjacent said actuating arm second end for attaching said actuating arm to said window;

a linking means extending between said guiding and actuating arms for linking said guiding arm adjacent said guiding arm second end to said actuating arm intermediate said actuating arm first and second ends, said linking means being configured so as to selectively allow and prevent pivotal movement between said guiding and actuating arms about a linking pivotal axis depending upon the distance between said guiding arm-to-window frame attachment means and said actuating arm-to-actuating rod attachment means;

whereby slidable movement of said actuating rod relative to said window frame along said rod longitudinal axis in a rod first direction causes the distance between said guiding arm-to-window frame attachment means and said actuating arm-to-actuating rod attachment means to decrease causing said linking means to assume an unlocked configuration and eventually causing said actuating arm to push said window towards said window open configuration;

slidable movement of said actuating rod relative to said window frame along said rod longitudinal axis in a rod second direction opposite to said rod first direction causes the distance between said guiding arm-to-window frame attachment means and said actuating arm-to-actuating rod attachment means to increase causing said actuating arm to pull said window towards said window closed configuration and eventually causing said linking means to assume a locked configuration.

20. A mechanism for selectively operating and locking a pivotable window, said window being pivotally attached to a window frame so as to pivot between a window open configuration and a window closed configuration about a window pivotal axis, said mechanism comprising:

an actuating rod, said actuating rod having an elongated configuration defining a rod first end, a rod second end and a rod longitudinal axis;

a rod mounting means for slidably mounting said actuating rod on said window frame so as to allow said actuating rod to slide relative to said window frame along said rod longitudinal axis;

a guiding arm, said guiding arm defining a guiding arm first end and a guiding arm second end;

a guiding arm-to-window frame attachment means extending between said guiding arm and said window frame for pivotally attaching said guiding arm adjacent said guiding arm first end to said window frame adjacent said actuating rod, said guiding arm-to-window frame attachment means allowing said guiding arm to pivot relative to said window frame about a guiding arm pivotal axis;

an actuating arm, said actuating arm defining an actuating arm first end, an actuating arm second end and an actuating arm longitudinal axis;

an actuating arm-to-actuating rod attachment means extending between said actuating arm and said actuating rod for pivotally attaching said actuating arm adjacent said actuating arm first end to said actuating rod, said actuating arm-to-actuating rod attachment means allowing said actuating arm to pivot relative to said actuating rod about an actuating arm pivotal axis an actuating arm-to-window attachment means extending from said actuating arm adjacent said actuating arm second end for attaching said actuating arm to said window;

a linking means extending between said guiding and actuating arms for linking said guiding arm adjacent said guiding arm second end to said actuating arm intermediate said actuating arm first and second ends, said linking means being configured so as to selectively allow and prevent pivotal movement between said guiding and actuating arms about a linking pivotal axis depending upon the distance between said guiding arm-to-window frame attachment means and said actuating arm-to-actuating rod attachment means;

said linking means including a linking slot formed in said actuating arm and a linking pin extending from said guiding arm and inserted in said linking slot, said linking slot defining a linking slot pivotal section allowing relative pivotal movement between said actuating and linking arms, said linking slot also defining an integrally extending linking slot locking section preventing relative pivotal movement between said actuating and linking arms;

said linking slot pivotal section allowing pivotal movement of said linking pin thereinto;

said linking slot locking section being narrower then said linking slot pivotal section and having a generally rectilinear configuration defining a slot longitudinal axis;

whereby slidable movement of said actuating rod relative to said window frame along said rod longitudinal axis in a rod first direction causes the distance between said guiding arm-to-window frame attachment means and said actuating arm-to-actuating rod attachment means to decrease causing said linking means to assume an unlocked configuration and eventually causing said actuating arm to push said window towards said window open configuration;

slidable movement of said actuating rod relative to said window frame along said rod longitudinal axis in a rod second direction opposite to said rod first direction causes the distance between said guiding arm-to-window frame attachment means and said actuating arm-to-actuating rod attachment means to increase causing said actuating and guiding arms to pivot about said linking pin located in said linking slot pivotal section until said window is in said window closed configuration, continued slidable movement of said actuating rod relative to said window frame along said rod longitudinal axis in said rod second direction causes said linking pin to slide into said linking slot locking section preventing relative pivotal movement between said guiding and actuating arms until slidable movement of said actuating rod relative to said window frame is reversed and said linking pin reaches said linking slot pivotal section.

* * * * *